US007511676B2

(12) United States Patent
Noda

(10) Patent No.: US 7,511,676 B2
(45) Date of Patent: Mar. 31, 2009

(54) HIGH FREQUENCY WAVE GLASS ANTENNA FOR AN AUTOMOBILE

(75) Inventor: Kazuyoshi Noda, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 126 days.

(21) Appl. No.: 11/752,016

(22) Filed: May 22, 2007

(65) Prior Publication Data

US 2007/0273597 A1 Nov. 29, 2007

(30) Foreign Application Priority Data

May 23, 2006 (JP) ..... 2006-142845

(51) Int. Cl.
*H01Q 1/32* (2006.01)

(52) U.S. Cl. ..... 343/713; 343/704

(58) Field of Classification Search ..... 343/713, 343/711, 712, 704
See application file for complete search history.

(56) References Cited

U.S. PATENT DOCUMENTS

| | | | | |
|---|---|---|---|---|
| 4,803,492 | A * | 2/1989 | Inaba et al. | 343/713 |
| 5,663,737 | A * | 9/1997 | Kakizawa | 343/713 |
| 5,986,612 | A * | 11/1999 | Nagy | 343/713 |
| 6,243,043 | B1 * | 6/2001 | Terashima et al. | 343/713 |
| 7,019,700 | B2 * | 3/2006 | Fujii et al. | 343/713 |
| 7,227,503 | B2 * | 6/2007 | Baba et al. | 343/713 |

FOREIGN PATENT DOCUMENTS

| | | |
|---|---|---|
| JP | 61-121603 | 6/1986 |
| JP | 4-213903 | 8/1992 |
| JP | 2002-033609 | 1/2002 |
| JP | 2002-135025 | 5/2002 |
| JP | 2003-283405 | 10/2003 |
| JP | 2005-101809 | 4/2005 |
| JP | 2005-303946 | 10/2005 |
| WO | WO 2006/001486 A1 | 1/2006 |

* cited by examiner

*Primary Examiner*—Hoang V Nguyen
(74) *Attorney, Agent, or Firm*—Oblon, Spivak, McClelland, Maier & Neustadt, P.C.

(57) ABSTRACT

A rear window glass sheet 10 includes a plurality of heating wires 2 and a plurality of bus bars 5*a* and 5*b* for feeding the heating wires 2, the heating wires 2 and the bus bars form a defogger, the heating wires 2 extend in a horizontal direction of the rear window glass sheet 10, and an antenna conductor 6 is disposed in an upper blank region of the rear window glass sheet 10 except for a defogger region. When it is assumed that there is a line, which passes through the center of the antenna conductor 6 in a left-to-right direction of the antenna conductor or the center of gravity thereof, and which extends parallel to the heating wire at the highest position, is called an imaginary parallel line 11, an island-like conductor 1*a* is disposed in an region of the rear window glass sheet 10 between the imaginary parallel line 11 and the heating wire 2*a* at the highest position as viewed three-dimensionally.

36 Claims, 15 Drawing Sheets

HIGH FREQUENCY WAVE GLASS ANTENNA FOR AN AUTOMOBILE

BACKGROUND OF THE INVENTION

1. Field of the Invention

The present invention relates to a high frequency wave glass antenna for an automobile, which is appropriate to receive a digital terrestrial television broadcast in Japan (471 to 771 MHz), a UHF band analog television broadcast (473 to 767 MHz) or a US digital television broadcast (698 to 806 MHz).

2. Discussion of Background

There has been proposed a high frequency wave glass antenna for an automobile, which is shown in FIG. 2 and which is suited to a VHF-High band for an analog television broadcast (see, e.g., JP-A-2005-101809, page 1 and FIG. 1). In this prior art, a rear window glass sheet 33 includes a defogger, which comprises a bus bar 35 and a bus bar 36 connected by a plurality of heating wires 37. The plural heating wires 37 have a short-circuit wire 15 formed at central portions thereof in a left-to-right direction thereof. The rear window glass sheet 33 includes a branch heating wires 37*a* in the vicinity of a central portion in the left-to-right direction in a blank region above the defogger, the branch heating wires being branching off of the heating wire disposed at the highest position. The rear window glass sheet has a region 31 on a right portion of the blank region for provision of an antenna conductor (not shown). The rear window glass sheet also has another region 32 on a left portion of the blank region for provision of another antenna conductor (not shown). In FIG. 2, reference symbol 34 designates the vehicle opening edge for a window.

The above-mentioned structure enables the prior art system to receive a VHF-High band for an analog television broadcast. However, when the prior art system is applied to receive a digital terrestrial television broadcast in Japan or a US digital television broadcast, heating wires 37 in an upper portion of the defogger mainly have an adverse effect on the antenna conductors, causing the problem of having an insufficient antenna gain.

It is an object of the present invention to provide a high frequency wave glass antenna for an automobile, which is capable of solving the above-mentioned problem of the prior art.

The invention provides a high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper blank region of the rear window glass sheet except for a defogger region;

wherein it is assumed that there is a line, which passes through the center of the antenna conductor or the center of gravity thereof, and which extends parallel to the heating wire at the highest position, is called an imaginary parallel line; and an island-like conductor containing a linear conductor is disposed at one or more locations in a region of the rear window glass sheet between the imaginary parallel line and the heating wire at the highest position as viewed three-dimensionally.

The present invention also provides a high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper blank region of the rear window glass sheet except for a defogger region;

wherein an island-like conductor containing a linear conductor is disposed at one or more locations in a blank space without having a bus bar or a heating wire, the blank space being in the defogger region.

The present invention also provides a high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; a first antenna conductor disposed in a right portion of an upper blank region of the rear window glass sheet except for a defogger region; and a second antenna conductor disposed in a left portion of the upper blank region of the rear window glass sheet except for the defogger region;

wherein when it is assumed that there is a straight line, which extends parallel to a plane parallel to a longitudinal direction of the automobile and the vertical direction, which passes through the center of the first antenna conductor in a left-to-right direction thereof or the center of gravity thereof, and which passes through at least one of the heating wires, this straight line is called a first antenna-side imaginary straight line;

wherein when it is assumed that there is a straight line, which extends parallel to the plane parallel to the longitudinal direction of the automobile and the vertical direction, which passes through the center of the second antenna conductor in a left-to-right direction thereof or the center of gravity thereof, and which passes through at least one of the heating wires, this straight line is called a second antenna-side imaginary straight line;

wherein when a heating wire, which starts with a top portion of a first bus bar or a portion of the first bus bar in the vicinity of the top portion, which extends toward the center of the rear window glass sheet in a left-to-right direction thereof, and which reaches and is connected to a top portion of the second bus bar or a portion of a second bus bar in the vicinity of the top portion, is called a highest original heating wire;

the highest original heating wire has at least one branch heating wire branched off thereof on the way to the center of the rear window glass sheet in the left-to-right direction after the highest original heating wire intersects or crosses over or under the first antenna-side imaginary straight line, after the branch heating wire branches off of the highest original heating wire and extends further, the branch heating wire bends so as to extend parallel or substantially parallel to the highest original heating wire and extend toward the center of the rear glass window sheet in the left-to-right direction, and bends to join and be connected to the highest original heating wire on the way to a location where the highest original heating wire intersects or crosses over or under the second antenna-side imaginary straight line;

wherein the first antenna conductor and the highest original heating wire have one or plural island-like conductors disposed therebetween;

wherein the second antenna conductor and the highest original heating wire have one or plural island-like conductors disposed therebetween;

wherein the highest original heating wire and the heating wire just under the highest original heating wire have one or plural island-like conductors disposed therebetween under the first antenna conductor;

wherein the highest original heating wire and the heating wire just under the highest original heating wire have one or plural island-like conductors disposed therebetween under the second antenna conductor; and wherein each of the island-like conductors contains a linear conductor.

By adopting the above-mentioned structure in accordance with the present invention, it is possible not only to minimize the adverse effect on an antenna conductor by a heating wire but also to improve the antenna gain on reception of a digital terrestrial television broadcast in Japan or a US digital television broadcast. It is also possible to minimize the possibility that the sight through the rear window glass sheet, in particular, the sight through the defogger region, and the appearance of the defogger region are damaged.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
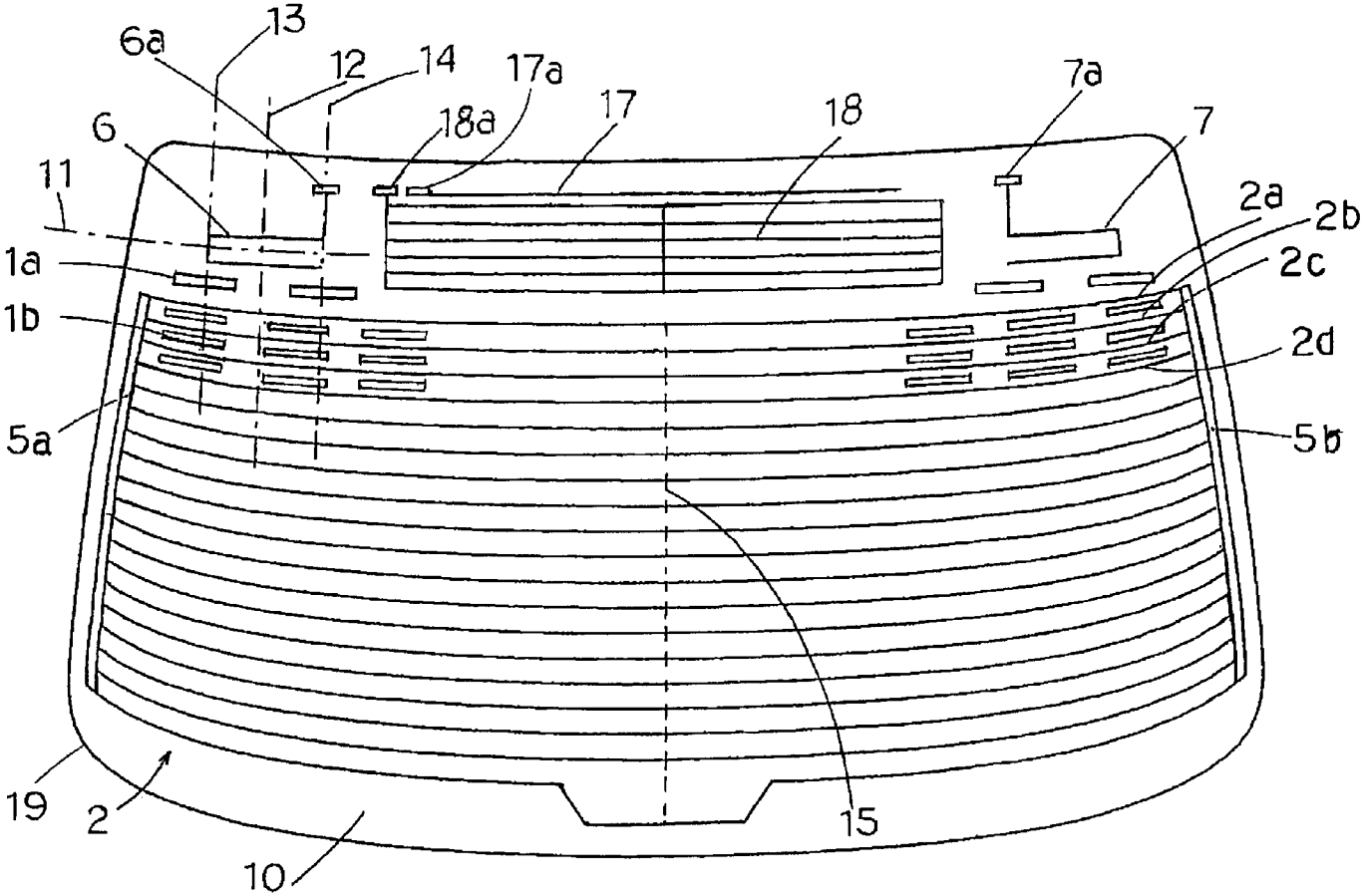
FIG. 1 is a plan view showing the high frequency wave glass antenna for an automobile according to an embodiment of the present invention.
Figure 2:
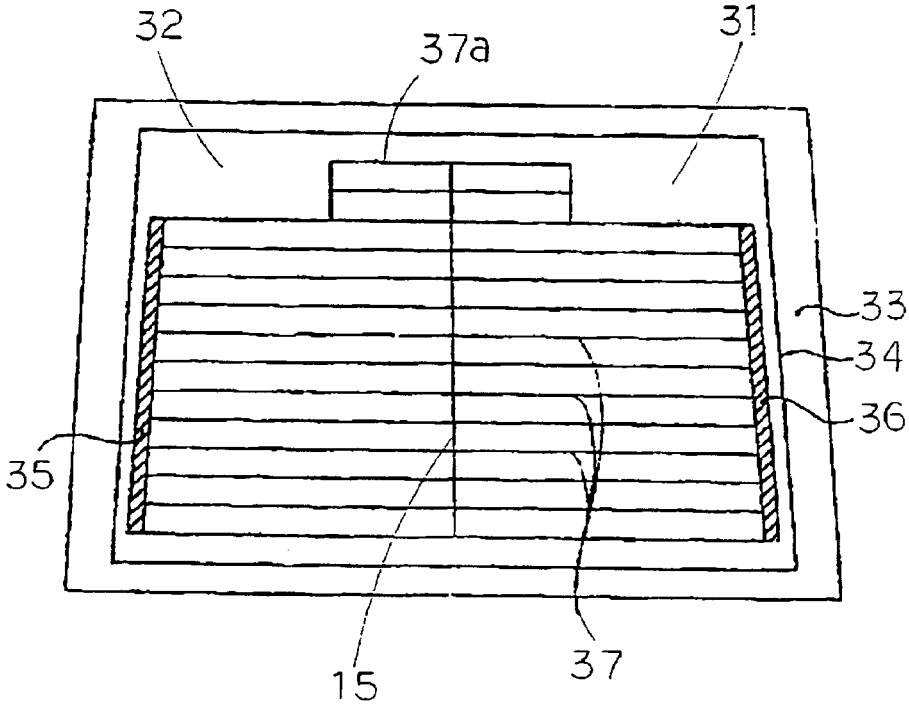
FIG. 2 is a plan view showing prior art.

Now, the high frequency wave glass antenna for an automobile according to the present invention will be described in detail, based on preferred embodiments which are shown in the accompanying drawings. FIG. 1 is a plan showing the high frequency wave glass antenna for an automobile according to an embodiment of the present invention.

In FIG. 1, reference symbol 1*a* designates an island-like conductor disposed outside a defogger region, reference symbol 1*b* designates an island-like conductor disposed in the defogger region, reference symbol 2 designates heating wires, reference symbol 2*a* designates the heating wire at the highest position, reference symbol 2*b* designates the heating wire at the second highest position, reference symbol 2*c* designates the heating wire at the third highest position, reference symbol 5*a* designates a first bus bar, reference symbol 5*b* designates a second bus bar, reference symbol 6 designates a first antenna conductor, reference symbol 6*a* designates the feed point of the first antenna conductor, reference symbol 7 designates a second antenna conductor, and reference symbol 7*a* designates the feed point of the second antenna conductor.

Reference symbol 10 designates the rear window glass sheet of an automobile, reference symbol 11 designates an imaginary parallel line, reference symbol 12 designates an antenna-side imaginary straight line, reference symbol 13 designates a first imaginary straight line, reference symbol 14 designates a second imaginary straight line, reference symbol 15 designates a short-circuit line (shown in a dotted line), reference symbol 17 designates an antenna conductor for an FM broadcast, reference symbol 17*a* designates the feed point of the antenna conductor 17 for an FM broadcast, reference symbol 18 designates an antenna conductor for an AM broadcast, reference symbol 18*a* designates the feed point of the antenna conductor 18 for an AM broadcast, and reference symbol 19 designates a vehicle opening edge for the window. It should be noted that the vehicle opening edge for the window 19 is a peripheral edge of the vehicle opening, which the rear window glass sheet is fitted in, and which serves for vehicle ground, and which is made of a conductive material, such as metal. In FIG. 1 and the figures showing the embodiment described later, the directions are referred to, based on the directions on these figures.

In the present invention, the rear window glass sheet 10 includes the plural heating wires 2, and the plural bus bars of feeding power to the plural heating wires 2, the plural heating wires 2 and the plural bus bars forming a defogger. The plural heating wires 2 extend in a horizontal direction or a substantially horizontal direction of the rear window glass sheet 10, in a direction along an upper edge portion of the rear window glass sheet, or in a direction along a lower edge portion of the rear window glass sheet. The antenna conductors are disposed in an upper blank region of the rear window glass sheet 10 except for the defogger region.

In the embodiment shown in FIG. 1, the first bus bar 5*a* is disposed so as to extend vertically or substantially vertically on a left edge portion of the rear window glass sheet 10, and the second bus bar 5*b* is disposed so as to extend vertically or substantially vertically on a right edge portion of the rear window glass sheet 10. The first antenna conductor 6 is disposed in a left portion of the upper blank region of the rear window glass sheet 10 except for the defogger region, the second antenna conductor 7 is disposed in a right portion of the upper blank region of the rear window glass sheet 10 except for the defogger region. However, the present invention is not limited to this mode, and the antenna conductors may be disposed anywhere in the upper blank region of the rear window glass sheet 10 except for the defogger region. There is no limitation to the number of the antenna conductors, which are disposed in the upper blank region of the window glass sheet 10 except for the defogger region.

The present invention will be described, citing the antenna conductor 6 as a representative of the antenna conductors. When it is assumed that the imaginary parallel line comprises a line passing through the center or the center of gravity of the first antenna conductor 6 and extending parallel to the heating wire 2*a* at the highest position, the island-like conductor 1*a* is disposed at one or plural locations in an region of the rear window glass sheet 10 between the imaginary parallel line 11 and the heating line 2*a* at the highest position as viewed three-dimensionally. In the present invention, the island-like conductor means a conductor, which has no connection with an antenna conductor in terms of direct current, which may contain a conductor formed in a loop shape, and which may be formed in any shape. The phrase "as viewed three-dimensionally" means to see from a direction perpendicular to a surface of the rear window glass sheet 10 in a region of the rear window glass sheet 10, where the island-like conductor 1*a* is disposed.

In the embodiment shown in FIG. 1, it is preferred from the viewpoint of ensuring the sight through the rear window that the island-like conductor 1*a* comprise only a linear conductor. However, the present invention is not limited to this mode, and the island-like conductor 1*a* may contain a conductor other than a linear conductor. These conditions are also applicable to the island-like conductor 1*b* in the defogger region, which will be described later. The linear conductor means a conductor having a line width of 3 mm or below.

In the present invention, the rear window glass sheet 10 includes at least one of the island-like conductor 1*a* and the island-like conductor 1*b*. It is preferred from the viewpoint of improving the antenna gain that the island-like conductors 1*a* and 1*b* be both disposed as shown in FIG. 1. However, the present invention is not limited to this mode, and the present invention is operable when at least one of the island-like conductors 1*a* and 1*b* is disposed. The island-like conductors 1*a* and 1*b* shown in FIG. 1 are insulated from the first antenna conductor 6, the defogger, the antenna conductor for an FM broadcast 17 and the antenna conductor for an AM broadcast 18 in terms of direct current.

In the embodiment shown in FIG. 1, the island-like conductor 1*b*, which comprises only a linear conductor, is disposed at plural locations in blank spaces having neither a bus bar nor a heating wire formed therein, in the defogger region. The island-like conductor 1*b* is disposed at each of three locations in respective portions, which are located between the heating wires 2*a* and 2*b*, between the heating wires 2*b* and 2*c* and between the heating wires 2*c* and 2*d* in the defogger region under the first antenna conductor 6. With respect to the improvement in the antenna gain, it is best that the island-like conductor 1*b* be disposed between the heating wires 2*a* and 2*b*. It is second best in terms of improving the antenna gain that the island-like conductor 1*b* be disposed between the heating wires 2*b* and 2*c*. In other words, the provision of the island-like conductor 1*b* between two heating wires closer to an antenna conductor contributes more to improve the antenna gain.

In the present invention, in a case where it is assumed that there is a first straight line, which extends parallel to a plane parallel to a longitudinal direction of the automobile and the vertical direction to the ground, which has contact with a left edge of the first antenna conductor 6, and which passes through at least one of the heating wires, the first straight line corresponds to the first imaginary straight line 13. In a case where it is assumed that there is a second straight line, which extends parallel to the plane parallel to the longitudinal direction of the automobile and the vertical direction, which has contact with a right edge of the first antenna conductor 6, and which passes through at least one of the heating wires, the second straight line corresponds to the second imaginary straight line 14.

When the island-like conductor 1*b* is disposed at a single location, it is preferred from the viewpoint of improving the antenna gain that the island-like conductor 1*b* is partly or entirely disposed between the first imaginary straight line 13 and the second imaginary straight line 14 as viewed three-dimensionally. When the island-like conductor 1*b* is disposed at plural locations, it is preferred from the viewpoint of improving the antenna gain that at least one of the island-like conductors 1*b* is partly or entirely disposed between the first imaginary straight line 13 and the second imaginary straight line 14 as viewed three-dimensionally. The phrase "as viewed three-dimensionally" means to see from a direction perpendicular to a surface of the rear window glass sheet 10 at the center or the center of gravity of the relevant island-like conductor 1*b*.

In consideration of both aspects of ensuring the sight and improving the antenna gain, it is preferred that the island-like conductor be disposed at each of a location between the heating wire 2*a* and the heating wire 2*b* and a location between the heating wire 2*b* and the heating wire 2*c*.

Figure 23:
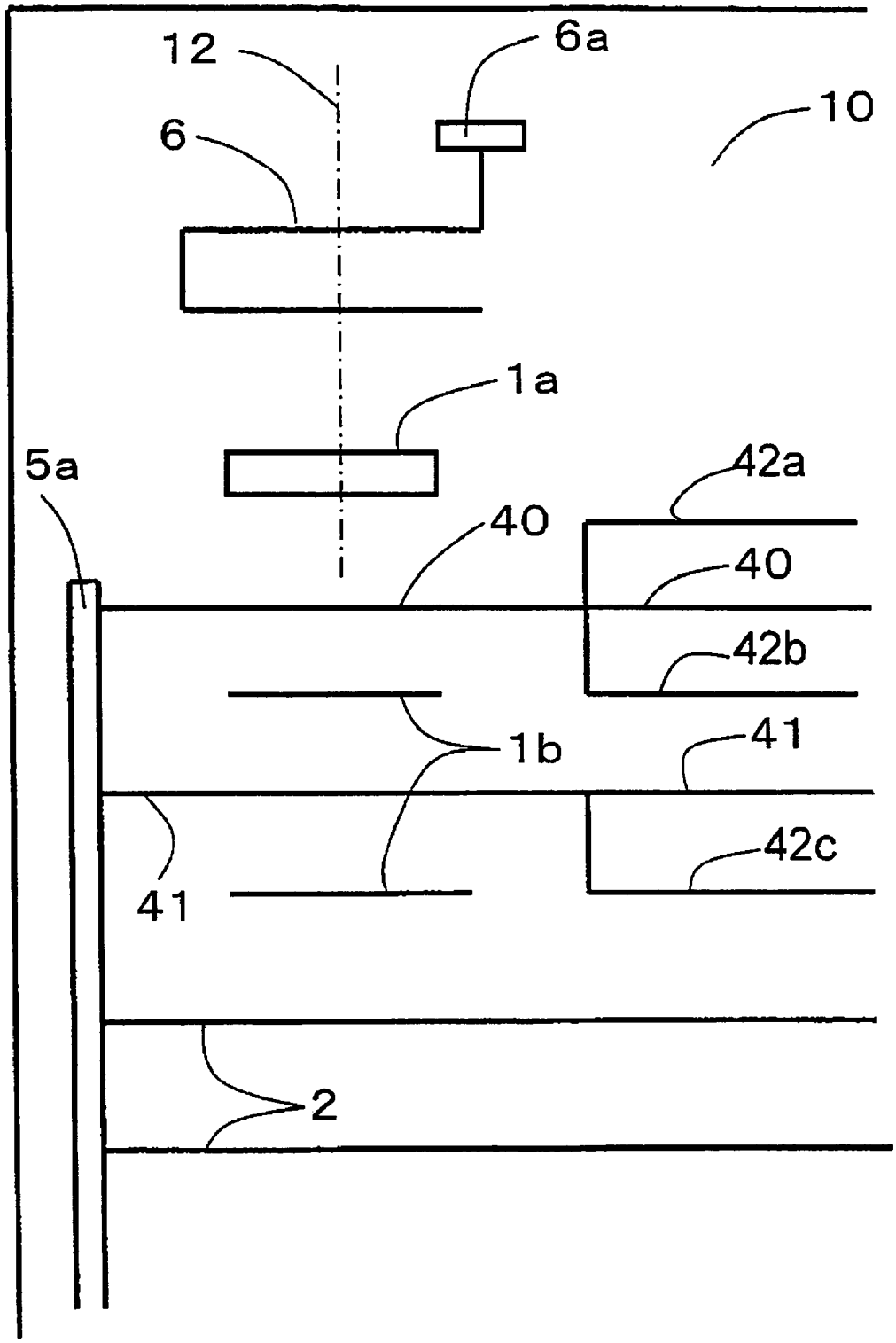
FIG. 23 is a plan view showing another embodiment different from the embodiment shown in FIG. 1.

FIG. 23 (seen from a car-interior-side or a car-exterior side) shows a different embodiment from the embodiment shown in FIG. 1 and shows an upper left area of the rear window glass sheet 10. FIG. 23 does not show an upper right area of the rear window glass sheet 10. It should be noted that the upper right area is axisymmetrical or substantially axisymmetrical with the upper left area about the center of the rear window glass sheet 10 in a left-to-right direction thereof. In FIG. 23, reference symbol 40 designates an original heating wire at the highest position, reference symbol 41 designates an original heating wire just under the original heating wire at the highest position, and reference symbols 42*a*, 42*b* and 42*c* designate branch heating wires, respectively. It should be noted that each of the original heating wires 40 and 41 is one mode of the heating wires.

In the embodiment shown in FIG. 23, the first antenna conductor 6 is disposed in a left portion of the upper blank region of the rear window glass sheet 10 except for the defogger region, and the second antenna conductor (not shown) is disposed in a right portion of the upper blank region of the rear window glass sheet 10 except for the defogger region.

In a case where it is assumed that there is a third straight line, which extends parallel to the plane parallel to the longitudinal direction of the automobile and the vertical direction, which passes through the center of the first antenna conductor 6 in a left-to-right direction of the first antenna conductor or the center of gravity thereof, and which passes through at least one of the heating wires, the third imaginary straight line is called a first antenna-side imaginary straight line 12. In a case where it is assumed that there is a fourth straight line, which extends parallel to the plane parallel to the longitudinal direction of the automobile and the vertical direction, which passes through the center of the second antenna conductor in a left-to-right direction of the second antenna conductor or the center of gravity thereof, and which passes through at least one of the heating wires, the fourth imaginary straight line is called a second antenna-side imaginary straight line (not shown).

The original heating wire 40 at the highest position is a heating wire, which starts with a top portion of the first bus bar 5*a* or a portion of the first bus bar in the vicinity of the top portion, which extends toward the center of the rear window glass sheet 10 in the left-to-right direction, and which reaches and is connected to a top portion of the second bus bar (not shown) or a portion of the second bus bar in the vicinity of the top portion. The original heating wire 40 at the highest position has the two branch heating wires 42*a* and 42*b* branched off thereof on the way to the center of the rear window glass sheet 10 in the left-to-right direction after the original heating wire 40 at the highest position intersects or crosses over or under the first antenna-side imaginary straight line 12.

After each of the branch heating wires 42*a* and 42*b* branches off of the original heating wire 40 at the highest position and extends further, each of the branch heating wires 42*a* and 42*b* bends so as to extend parallel or substantially parallel to the original heating wire 40 at the highest position and extend toward the center of the rear glass window sheet 10 in the left-to-right direction, and bends to join and be connected to the original heating wire 40 at the highest position on the way to a location where the original heating wire 40 at the highest position intersects or crosses over or under the second antenna-side imaginary straight line.

In the embodiment shown in FIG. 23, the original heating wire 40 at the highest position has the two branch heating wires 42*a* and 42*b*, which is preferred in terms of antifogging effect and improvement in the antenna gain. However, the present invention is not limited to this mode, and the original heating wire at the highest position may have a single branch heating wire or more than two branch heating wires. In the embodiment shown in FIG. 23, the original heating wire 40 at the highest position has the respective two branch heating wires disposed thereabove and thereunder. However, the present invention is not limited to this mode, and the original heating wire 40 at the highest position may have one or more branch heating wires disposed only thereabove or thereunder. When the branch heating wires 42*a* and 42*b* are disposed closer to the center of the rear window glass sheet 10 in the left-to-right direction than the first antenna-side imaginary straight line 12, the antenna gain is further improved. From the point of view that the original heating wire 40 at the highest position has more heating current flowing than the branch heating wires 42*a* and 42*b*, it is preferred that the original heating wire 40 at the highest position have a greater conductor width than the branch heating wires 42*a* and 42*b*.

In the embodiment shown in FIG. 23, the original heating wire 41 is disposed so as to extend parallel or substantially parallel to the original heating wire 40 at the highest position, being spaced from the original heating wire 40 at the highest position by a certain distance just under the original heating wire 40 at the highest position. The original heating wire 41 starts with the first bus bar 5*a*, extends toward the center of the rear glass window sheet in the left-to-right direction, and reaches and is connected to the second bus bar.

The original heating wire 41 has the branch heating wire 42*c* branched off thereof on the way to the center of the rear window glass sheet 10 in the left-to-right direction after the original heating wire 41 intersects or crosses over or under the first antenna-side imaginary straight line 12.

After the branch heating wire 42*c* branches off of the original heating wire 41 and extend further, the branch heating wire 41 bends so as to extend parallel or substantially parallel to the original heating wire 41, and bends to join and be connected to the original is heating wire 41 on the way to a location where the original heating wire 41 intersects or crosses over or under the second antenna-side imaginary straight line.

In the embodiment shown in FIG. 23, the original heating wire 41 has the single branch heating wire 42*c*, which is preferred in terms of antifogging effect and improvement in the antenna gain. However, the present invention is not limited to this mode, and the original heating wire 41 may have a plurality of branch heating wires. In the embodiment shown in FIG. 23, the original heating wire 41 has the branch heating wire 42*c* disposed thereunder. However, the present invention is not limited to this mode, and the original heating wire 41 may have one or more branch heating wires disposed thereabove and thereunder, respectively. The original heating wire 41 may have one or more branch heating wires disposed only thereabove. The original heating wire 41 may have a plurality of branch heating wires disposed only thereunder.

In the embodiment shown in FIG. 23, the first antenna conductor 6 and the original heating wire 41 at the highest position have a single island-like conductor 1*a* disposed therebetween, and the island-like conductor 1*a* is formed in a rectangular or substantially rectangular loop shape. It is preferred to adopt such a mode from the viewpoint of improving the antenna conductor. However, the present invention is not limited to this mode. The island-like conductor may be disposed in any other mode proposed by the present invention, instead of being disposed in this mode.

In the embodiment shown in FIG. 23, the original heating wire 40 at the highest position and the original heating wire 41 have an island-like conductor 1*b* disposed therebetween, and the original heating wire 41 and the heating wire 2 just thereunder also have another island-like conductor 1*b* disposed therebetween. Each of the two island-like conductors 1*b* comprises a straight line or substantially straight line conductor. It is preferred to adopt such a mode from the viewpoint of ensuring the sight. However, the present invention is not limited to this mode. The island-like conductors may be disposed in any other mode proposed by the present invention, instead of being disposed in this mode.

Figure 3:
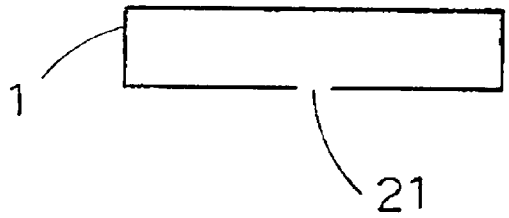
FIG. 3 is a plan view showing an island-like conductor according to another embodiment, which is formed in a different shape from the ones in the embodiment shown in FIG. 1.
Figure 4:
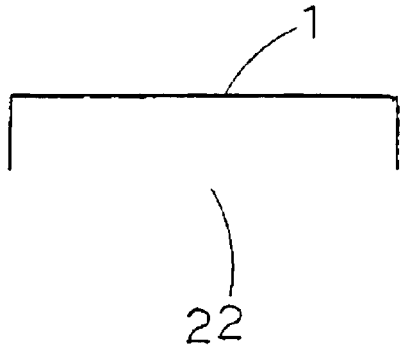
FIG. 4 is a plan view showing an island-like conductor according to another embodiment, which is formed in a different shape from the ones in the embodiment shown in FIG. 1.
Figure 5:
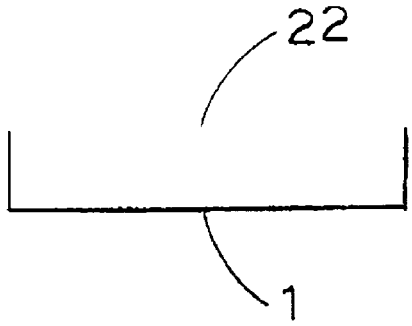
FIG. 5 is a plan view showing an island-like conductor according to another embodiment, which is formed in a different shape from the ones in the embodiment shown in FIG. 1.
Figure 6:
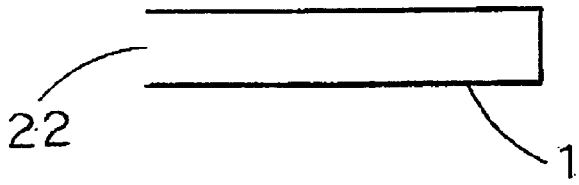
FIG. 6 is a plan view showing an island-like conductor according to another embodiment, which is formed in a different shape from the ones in the embodiment shown in FIG. 1.
Figure 7:
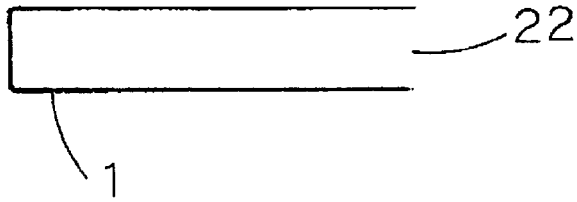
FIG. 7 is a plan view showing an island-like conductor according to another embodiment, which is formed in a different shape from the ones in the embodiment shown in FIG. 1.

It is preferred from the viewpoint of improving the antenna gain that the island-like conductor 1*a* outside the defogger region and the linear conductor contained in the island-like conductor 1*b* in the defogger region be formed in a loop shape. However, the present invention is not limited to this mode, and each of the island-like conductors may be formed in such a semi-loop shape that a discontinuity 21 is formed in a portion of a loop shape (FIG. 3). It should be noted that when explanation is made about the shape of the island-like conductor 1*a* and the shape of the island-like conductors 1*b*, the island-like conductor 1*a* and the island-like conductors 1*b* are collectively called the island-like conductor 1.

In the embodiment shown in FIG. 3, the discontinuity 21 is formed in a lower portion of the loop shape.

However, the present invention is not limited to this mode. The discontinuity 21 may be formed in an upper portion, a right portion or a left portion of the loop shape contained in the island-like conductor 1.

In each of the embodiments shown in FIGS. 4 through 9, the linear conductor contained in the island-like conductor 1 is formed in such a shape as to have a cut-out portion 22 like something that has a portion of a loop shape cut out therein. In the embodiment shown in FIG. 4, the linear conductor is formed in such a shape that the cut-out portion 22 is formed in a lower portion of the loop shape. In the embodiment shown in FIG. 5, the linear conductor is formed in such a shape that the cut-out portion 22 is formed in an upper portion of the loop shape. In the embodiment shown in FIG. 6, the linear conductor is formed in such a shape that the cut-out portion 22 is formed in a left portion of the loop shape. In the embodiment shown in FIG. 7, the linear conductor is formed in such a shape that the cut-out portion 22 is formed in a right portion of the loop shape. In other words, when the loop shape is quadrangular or substantially quadrangular in each of the embodiments shown in FIGS. 4 through 7, one side of the four sides is cut out. In the present invention, it is meant that the cut-out portion has a longer length than the discontinuity.

Figure 8:
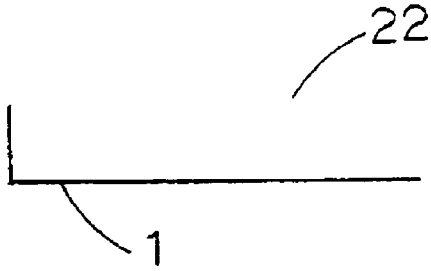
FIG. 8 is a plan view showing an island-like conductor according to another embodiment, which is formed in a different shape from the ones in the embodiment shown in FIG. 1.
Figure 9:
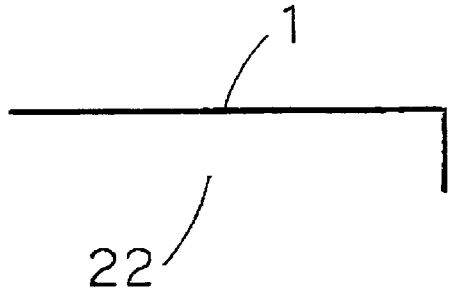
FIG. 9 is a plan view showing an island-like conductor according to another embodiment, which is formed in a different shape from the ones in the embodiment shown in FIG. 1.

In the embodiment shown in FIG. 8, the loop shape has an upper portion and a right portion cut out therein. When the embodiment shown in FIG. 8 is expressed in other words, the quadrangular or substantially quadrangular loop shape has an upper side and a right side cut out therein. The upper side and the right side are two adjacent sides. In the embodiment shown in FIG. 9, the loop shape has a lower portion and a left portion cut out therein. When the loop shape is quadrangular or substantially quadrangular in each of the embodiments, it is preferred from the viewpoint of improving the antenna gain that at least one of the upper side and the lower side of the loop shape extend parallel or substantially parallel to the heating wire closest to the island-like conductor 1 as shown in, e.g., FIG. 1.

Figure 10:
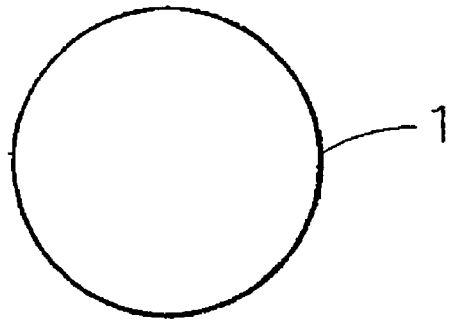
FIG. 10 is a plan view showing an island-like conductor according to another embodiment, which is formed in a different shape from the ones in the embodiment shown in FIG. 1.
Figure 11:
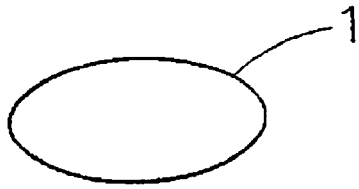
FIG. 11 is a plan view showing an island-like conductor according to another embodiment, which is formed in a different shape from the ones in the embodiment shown in FIG. 1.
Figure 12:
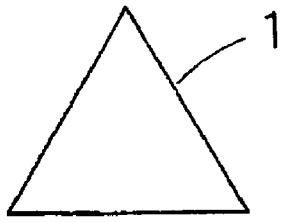
FIG. 12 is a plan view showing an island-like conductor according to another embodiment, which is formed in a different shape from the ones in the embodiment shown in FIG. 1.

In the embodiment shown in FIG. 10, the linear conductor contained in the island-like conductor 1 is formed in a circular or substantially circular shape. In the embodiment shown in FIG. 11, the linear conductor contained in the island-like conductor 1 is formed in an oval or substantially oval shape. In the embodiment shown in FIG. 12, the linear conductor contained in the island-like conductor 1 is formed in a triangular or substantially triangular shape.

When the loop is formed in an oval or substantially oval shape, it is preferred from the viewpoint of improving the antenna gain that the major axis of the oval or substantially oval shape extend parallel or substantially parallel to the heating wire closest to the island-like conductor 1.

The island-like conductor may be configured to have a main portion comprising a straight line or substantially straight line conductor. It is preferred from the viewpoint of securing the sight to adopt such a mode. It is more preferred that the island-like conductor comprise a straight line or substantially straight line conductor. The main portion means a portion of the island-like conductor that occupies 80% or more of the maximum width of the island-like conductor in a longitudinal direction thereof.

In a case where the island-like conductor adopts this mode, when the frequency of a received radio wave has a wavelength of $\lambda_0$ in air, when glass has a shortening coefficient of wavelength of k, when the formula of k=0.64 is established, when the formula of $\lambda_g=\lambda_0 \cdot k$ is established; it is preferred from the viewpoint of improving the antenna gain that the island-like conductor have a maximum width of 0.13 $\lambda_g$ to 0.44 $\lambda_g$, in particular, 0.26 $\lambda_g$ to 0.43 $\lambda_g$ in the longitudinal direction thereof.

It is preferred from the viewpoint of improving the antenna gain that the island-like conductor have a linear conductor attached thereto so as to extend perpendicular or substantially perpendicular thereto and to have a conductor length of not longer than ⅕ of the maximum width thereof in the longitudinal direction. Examples of this mode include the embodiments shown in FIGS. 4, 5, 8 and 9.

Explanation will be made about a case where the main portion of the island-like conductor comprises a straight line or substantially straight line conductor, and where the island-like conductor is disposed at one or more locations in a region of the rear window glass sheet 10 between the imaginary parallel line 11 and the heating wire 2*a* at the highest position as viewed three-dimensionally. When the island-like conductor is disposed at a single location, it is preferred that the average distance between the island-like conductor and the relevant antenna conductor be 0.06 $\lambda_g$ to 200 mm, in particular, 0.076 $\lambda_g$ to 150 mm. When the island-like conductor is disposed at plural locations, it is preferred that the average distance between each of the island-like conductors and the relevant antenna conductor be 0.06 $\lambda_g$ to 200 mm, in particular, 0.076 $\lambda_g$ to 150 mm. When the average distance is 0.06 $\lambda_g$ or above, it is possible to advantageously improve the antenna gain in comparison with a case the average distance is less than 0.06 $\lambda_g$. When the average distance is 200 mm or below, it is possible to advantageously make the glass antenna is smaller in comparison with a case where the average distance is longer than 200 mm.

Figure 13:
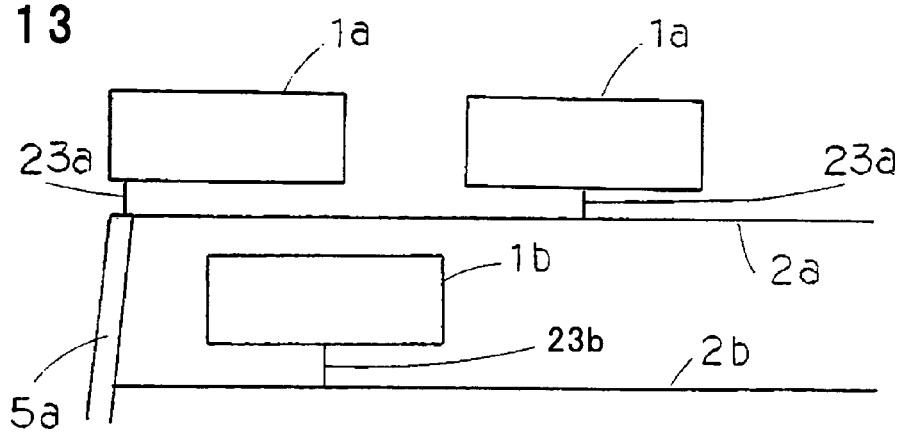
FIG. 13 is a plan view showing island-like conductors according to another embodiment, wherein the island-like conductors are connected to heating wires and a bus bar through connecting conductors.

In the embodiment shown in FIG. 13, a left island-like conductor 1*a* is connected to the bus bar 5*a* through a connecting conductor 23*a*, and a right island-like conductor 1*a* and an island-like conductor 1*b* are connected to the heating wires 2*a* and 2*b* through respective connecting conductors 23*a* and 23*b*.

Figure 14:
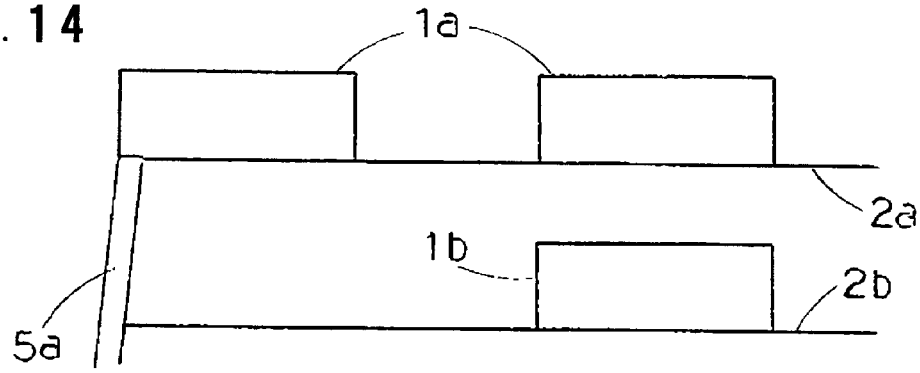
FIG. 14 is a plan view showing island-like conductors according to another embodiment, wherein the island-like conductors are connected directly to the heating wires and the bus bar.

In the embodiment shown in FIG. 14, a left island-like conductor 1*a* is directly connected to the bus bar 5*a*, and a right island-like conductor 1*a* and an island-like conductor 1*b* are directly connected to the heating wires 2*a* and 2*b*, respectively.

Figure 15:
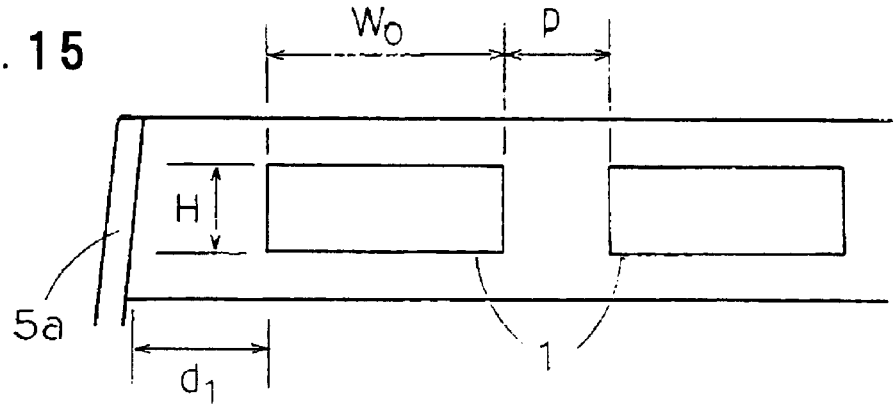
FIG. 15 is a plan view showing the dimensional relationship of an island-like conductor.

FIG. 15 shows the dimensional relationship of each of the island-like conductors 1. In FIG. 15, reference symbol H designates the maximum vertical width of each of the island-like conductors 1 in the vertical direction thereof, reference symbol $W_0$ designates the maximum transverse width of each of the island-like conductors in the transverse direction thereof, and reference symbol p designates the distance between adjacent island-like conductors 1.

It is preferred from the viewpoint of improving the antenna gain that H and $W_0$ exist in a region surrounded by the following curve A1 and the following straight line A2 in a region satisfying the formula of $H \geqq 0.032\ \lambda_g$ on a plane of coordinates representing H as the horizontal axis and $W_0$ as the vertical axis.

| | |
|---|---|
| $W_0 = -(56.8/\lambda_g)\ (H - 0.035\lambda_g)^2 + 0.38\lambda_g$ | curve A1 |
| $W_0 = 0.025\lambda_g$ | straight line A2 |

It is preferred from the viewpoint of improving the antenna gain that H and $W_0$ exist in a region surrounded by the straight line A2, the following straight line A3 and the following straight line A4 in a region satisfying the formula $H < 0.032\ \lambda_g$.

| | |
|---|---|
| $W_0 = 0.38\lambda_g$ | straight line A3 |
| $H = 0.016\lambda_g$ | straight line A4 |

It is more preferred that the surrounded region comprise a region surrounded by the following curves B1, B2 and B3.

| | |
|---|---|
| $W_0 = -(47.3/\lambda_g)\ (H - 0.032\lambda_g)^2 + 0.362\lambda_g$ | curve B1 |
| $W_0 = -(28.4/\lambda_g)\ (H - 0.032\lambda_g)^2 + 0.21\lambda_g$ | curve B2 |
| $H = 0.0256\lambda_g$ | curve B3 |

Figure 20:
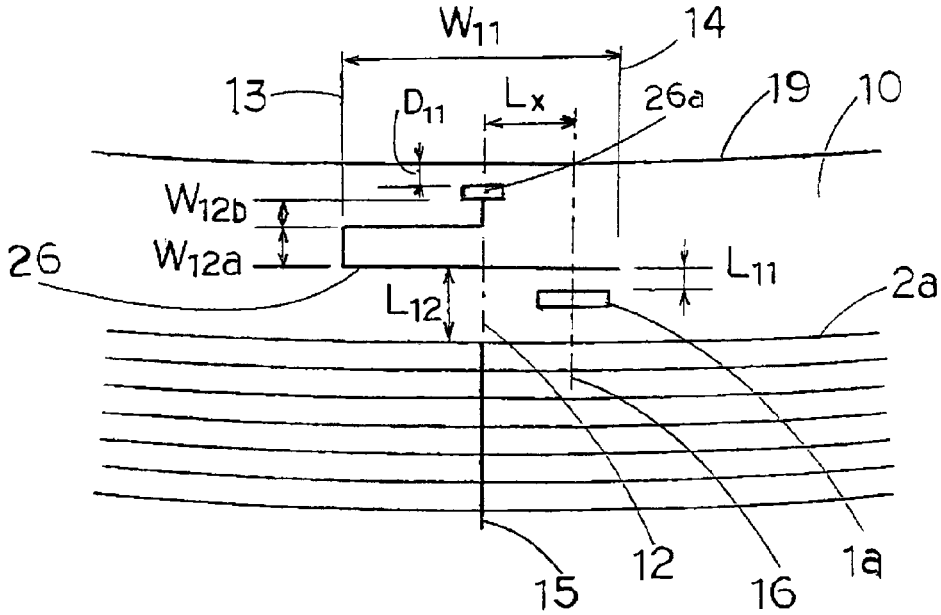
FIG. 20 is a plan view showing the mode of Example 2.

In a case where it is assumed that as shown in FIG. 20 described later, there is a fifth straight line, which extends parallel to the plane parallel to the longitudinal direction of the automobile and the vertical direction, which passes through the center of an antenna conductor 26 in a left-to-right direction thereof, and which passes through the heating wire 2*a* at the highest position, the fifth straight line is called an antenna-side imaginary line 12. In a case where it is assumed that there is a six straight line, which extends parallel to the plane parallel to the longitudinal direction of the automobile and the vertical direction, which passes through the center of an island-like conductor 1*a* in a left-to-right direction thereof, and which passes through the heating wire 2*a* at the highest position, the six straight line is called an island-like-conductor-side imaginary straight line 16, it is preferred from the viewpoint of improving the antenna gain that the antenna conductor 26 and the island-like conductor 1*a* be disposed on or in the rear window glass sheet 10 so that the shortest distance between the antenna-side imaginary line 12 and the island-like-conductor-side imaginary straight line 16 is 1.1 $\lambda_g$ or below in FIG. 21 described later as viewed three-dimensionally. The phrase "as viewed three-dimensionally" means to see from a direction perpendicular to a surface of the rear window glass sheet 10 in a region of the rear window glass sheet 10, where the center or the center of gravity of the island-like conductor 1*a* exists. This range is more preferably 0.6 $\lambda_g$ or below, particularly preferably 0.5 $\lambda_g$ or below and most preferably 0.4 $\lambda_g$ or below. It is preferred from the viewpoint of improving the antenna gain that the shortest distance between the antenna-side imaginary straight line 12 and the island-like-conductor-side imaginary straight line 16 be 0.1 $\lambda_g$ or above.

It is preferred from the viewpoint of improving the antenna gain that the antenna conductor 26 and the island-like conductor 1*a* be disposed on or in the rear window glass sheet 10 so that the shortest distance between the antenna-side imaginary straight line 12 and the island-like-conductor-side imaginary straight line 16 is 0.1 $\lambda_g$ or above as viewed three-dimensionally.

Figure 21:
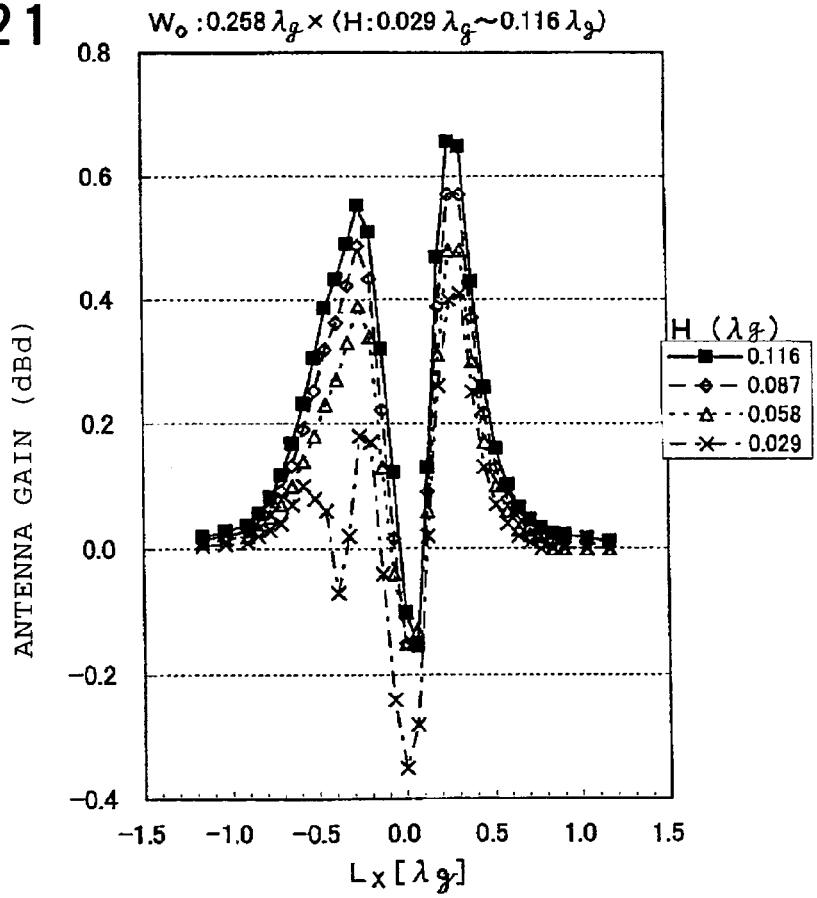
FIG. 21 is a characteristic graph of $L_x$-antenna gain in Example 2.

From the viewpoint that the formulas of $W_0 = 0.258\ \lambda_g$ (80 mm), $H = 0.029\ \lambda_g$ (9 mm) to $0.116\ \lambda_g$ (36 mm) and $L_{11}$ (the shortest distance between the antenna conductor and the island-like conductor 1*a* in the extending direction of the antenna-side imaginary straight line 12) $= 0.029\ \lambda_g$ (9 mm) are established in FIG. 21, the allowable ranges of $W_0$, H and $L_{11}$ are defined with respect to the above-mentioned range of the shortest distance between the antenna-side imaginary straight line 12 and the island-like-conductor-side imaginary straight line 16 and are listed in Table 1.

TABLE 1

| | $W_0$ ($\lambda_g$) | H ($\lambda_g$) | $L_{11}$ ($\lambda_g$) |
|---|---|---|---|
| Preferred range as allowable range | $0.029\lambda_g$ to $0.389\lambda_g$ | $0.0145\lambda_g$ to $0.174\lambda_g$ | $0.0032\lambda_g$ to $0.087\lambda_g$ |
| More preferred range as allowable range | $0.181\lambda_g$ to $0.335\lambda_g$ | $0.0204\lambda_g$ to $0.151\lambda_g$ | $0.0145\lambda_g$ to $0.0582\lambda_g$ |
| Particularly preferred range as allowable range | $0.206\lambda_g$ to $0.310\lambda_g$ | $0.0233\lambda_g$ to $0.140\lambda_g$ | $0.0204\lambda_g$ to $0.0436\lambda_g$ |

From the viewpoint that the value of $W_0$ is fixed at $0.258\ \lambda_g$ (80 mm), it is difficult to cope with a change in $W_0$ by discussing, based on the shortest distance between the antenna-side imaginary straight line 12 and the island-like-conductor-side imaginary straight line 16, the relative position of the island-like conductor 1*a* to the antenna conductor, which is capable of enjoying the effect of the island-like conductor 1*a*.

When consideration is taken based on FIG. 21, it is preferred that the island-like conductor 1*a* be partly or entirely disposed between the first imaginary straight line 13 and the second imaginary straight line 14 as viewed three-dimensionally. In other cases, it is preferred from the viewpoint of improving the antenna gain that a shorter one of the shortest distance between the island-like conductor 1*a* and the first imaginary straight line 13, and the shortest distance between the island-like conductor 1*a* and the second imaginary straight line 14 be 0.728 $\lambda_g$ or below. This range is more preferably 0.228 $\lambda_g$ or below, particularly preferably 0.128 $\lambda_g$ or below and most preferably 0.028 $\lambda_g$ or below. If an attempt is made to define the allowable ranges of $W_0$, H and $L_{11}$, these allowable ranges are shown in Table 1.

It is preferred from the viewpoint of improving the antenna gain that $\lambda_0$ and $\lambda_g$ be set at the wavelength of the center frequency of a desired broadcast frequency band in the air. When it is desired to well receive the entire range of the digital terrestrial television broadcast band in Japan (471 to 771 MHz), it is preferred from the viewpoint of improving the antenna gain that $\lambda_0$ and $\lambda_g$ be 483.1 mm and 309.2 mm, respectively, so as to correspond to a wavelength of 621 MHz, which is the center frequency of the digital terrestrial television broadcast band in Japan.

When it is desired to well receive the current digital broadcast frequency band (471 to 600 MHz) in the digital terrestrial television broadcast band in Japan, $\lambda_0$ and $\lambda_g$ are 560 mm and 358.5 mm, respectively, so as to correspond to a wavelength of 535.5 MHz, which is the center frequency of the center frequency of this current broadcast frequency band.

When it is desired to well receive the main broadcast band (471 to 710 MHz) in the digital terrestrial television broadcast band in Japan, it is preferred from the viewpoint of improving the antenna gain that $\lambda_0$ and $\lambda_g$ are 508 mm and 325 mm, respectively, so as to correspond to a wavelength of 590.5 MHz, which is the center frequency of this main broadcast band.

From the viewpoint of obtaining the antifogging effect and ensuring the sight, the distance between adjacent heating wires 2 is preferably 10 to 40 mm, more preferably 22 to 34 mm and most preferably 25 to 32 mm. It is preferred from the viewpoint of obtaining the antifogging effect uniformly that the distance between adjacent heating wires, which are disposed in or on the rear window glass sheet, be equal or substantially equal.

In the present invention, it is preferred that the first antenna conductor 6 and the second antenna conductor 7 be used for a digital terrestrial television broadcast in Japan, a US digital television broadcast, a Chinese digital television broadcast or a European digital television broadcast.

When a digital terrestrial television broadcast in Japan is received, it is preferred that the radio wave received by each of the first antenna conductor 6 and the second antenna conductor 7 contain a frequency ranging from 471 to 771 MHz.

When the current broadcast frequency band (471 to 600 MHz) in the digital terrestrial television broadcast in Japan is received, it is preferred that the radio wave received by each of the first antenna conductor 6 and the second antenna conductor 7 contain a frequency ranging from 471 to 600 MHz.

When a US digital television broadcast is received, it is preferred that a received radio wave contain a frequency ranging from 698 to 806 MHz.

In the embodiment shown in FIG. 1, either one of the bus bars 5*a* and 5*b* is electrically connected to the positive electrode of a DC power source (not shown), and the remaining one of the bus bar is electrically connected to the negative electrode of the DC power source. In the embodiment shown in FIG. 1, the rear window glass sheet 10 includes the two bus bars 5*a* and 5*b*. However, the present invention is not limited to this mode. The rear window glass sheet may include more is than two bus bars, such as three or four bus bars. In other words, the present invention is applicable as long as the defogger is configured so that a voltage is applied across two bus bars, which are close to an antenna conductor side. The embodiment shown in FIG. 1 may be seen from the car-interior-side or the car-exterior-side. It should be noted that the short-circuit wire 15 be disposed to adjust the impedance of the defogger as needed.

It is preferred from the viewpoint of improving the F/B ratio that the rear window glass sheet 10 be inclined at an angle of 18 to 36°, in particular 20 to 33°, with respect to the horizontal direction.

In the present invention, each of the island-like conductors, the bus bars, the heating wires, the short-circuit wire, the antenna conductors and the feed points is normally formed by printing paste containing conductive metal, such as silver paste, on the car-interior-side surface of the rear window glass sheet 10 and baking the printed paste. However, the present invention is not limited to this forming method. A linear member or foil member, which comprises a conductive substance, such as copper, may be formed on the car-interior-side surface or the car-exterior-side surface of the rear window glass sheet 10, or is disposed in the rear window glass sheet 10.

In the embodiment shown in FIG. 1, each of the first antenna conductor 6 and the second antenna conductor 7 is a single-pole antenna, which has a single feed point. However, the present invention is not limited to this mode. In the present invention, there is no limitation to this kind of the antennas. Each of the first antenna conductor 6 and the second antenna conductor 7 may be a bipole antenna having a single feed point at respective portions and including a grounded conductor (not shown). In the present invention, it is preferred from the viewpoint of improving the antenna gain that each of the antenna conductors have the feed point disposed at an upper portion thereof or an obliquely upper portion thereof.

In the present invention, it is preferred that diversity reception be performed between the first antenna conductor 6 and the second antenna conductor 7. The reason is that the antenna performance is brought close to a non-directional property. There is no limitation to the number of antenna conductors disposed on the automobile in addition to the first antenna conductor 6 and the second antenna conductor 7. Diversity reception may be performed between a combination of the first antenna conductor 6 and the second antenna conductor 7 in the present invention, and another antenna, such as a pole antenna, and/or another glass antenna.

EXAMPLES

Although the present invention will be described in reference to Examples, it should be noted that the present invention is not limited to these Examples, and that various variations or modifications are included in the present invention as long as the variations and modifications do not depart from the spirit of the invention. Now, the Examples will be described in detail, referring to the accompanying drawings.

Since characteristics associated with the antenna gains of horizontally polarized waves are calculated in Example 1, Example 2, Example 4 and Example 5 described below, common specifications will be explained first. Calculation is made according to the moment method. The antenna gains are calculated based on antenna gain average values (every 1°) within −90° to +90° in the horizontal direction (automobile backside) when the center of a rear portion of the automobile is set at 0 (zero)°, the left direction of the automobile is set at +90° and the center of a front portion of the automobile is set at +180°.

Calculation is made with the dimensions of the vehicle opening edge for a window 19 being contained as a computational element and with the dimensions of the rear window glass sheet 10 being not contained as a computational element. It is assumed that the rear window glass sheet 10 is inclined at an angle of 22° with respect to the horizontal direction. It is also assumed that the heating wires 2 are found so as to be symmetrical about the center in the left-to-right direction thereof as the symmetrical axis.

It is also assumed that both of the bus bars 5*a* and 5*b* are isolated from a DC power source (not shown) in terms of direct current. It is also assumed that the short-circuit line 15 is disposed in or on the rear window glass sheet 10.

In Example 1, Example 2, Example 4 and Example 5, the antenna gains are calculated at every 30 MHz in a frequency band of 471 to 771 MHz. In the characteristic graphs in Example 1, Example 2, Example 4 and Example 5, the antenna gains are represented by average values at every 30 MHz. In these characteristic graphs, respective values of $\lambda_g$, which are standardized with $\lambda_g$, are $\lambda_g$ (309.2 mm), which corresponds to the center frequency (621 MHz) of 471 to 771 MHz.

Example 1

In each sample, a high frequency wave glass antenna for an automobile as shown in FIG. 1 (seen from the car-interior-side) is assumed. Assuming that the rear window glass sheet 10 includes only the first antenna conductor 6 without the second antenna conductor 7 in FIG. 1, the antenna gains are calculated only about the first antenna conductor 6.

Figure 16:
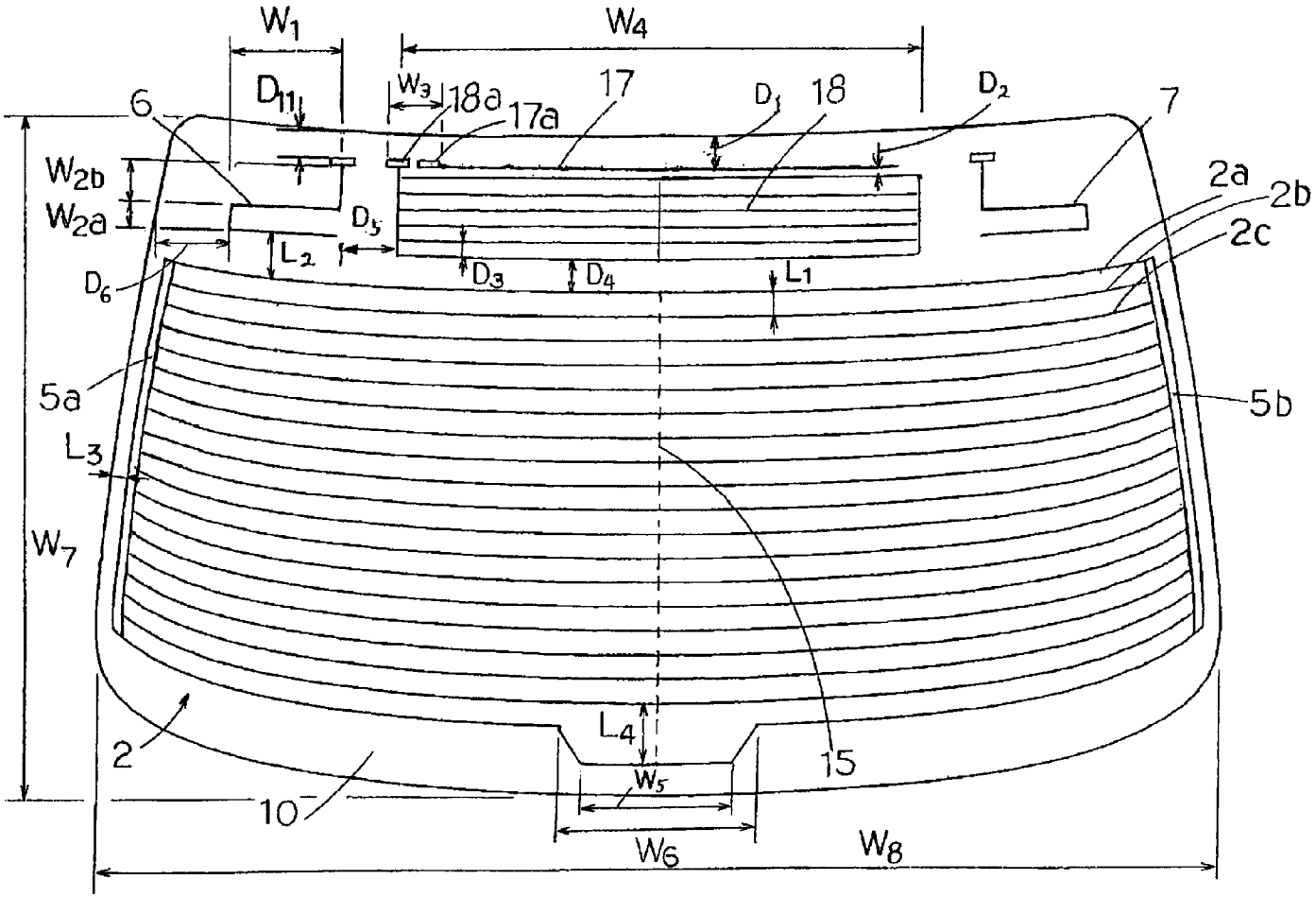
FIG. 16 is a plan view showing the dimensional relationship of the embodiment shown in FIG. 1.
Figure 17:
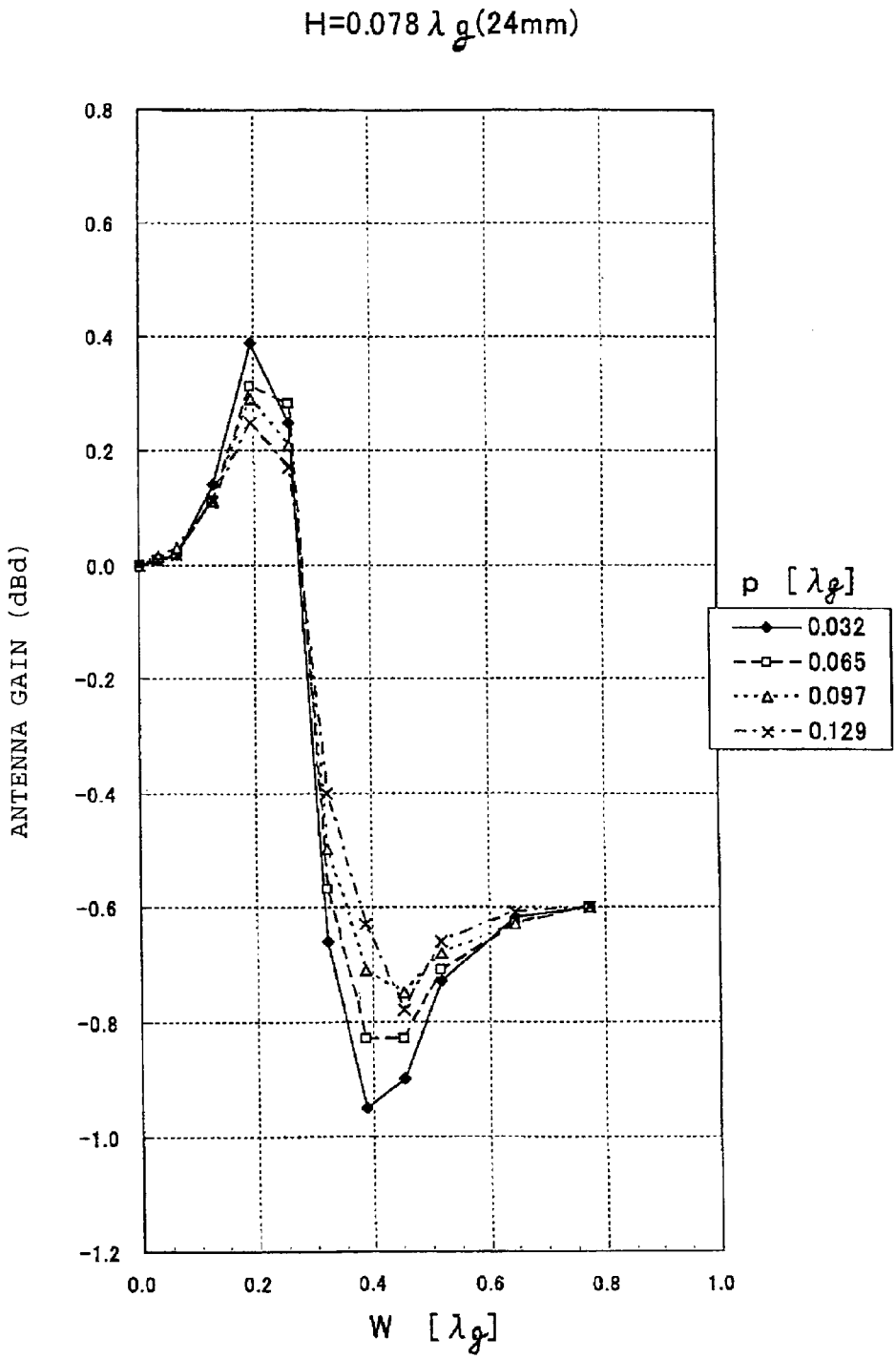
FIG. 17 is a characteristic graph of $W_0$-antenna gain at $H=0.078\ \lambda_g$ in Example 1.
Figure 18:
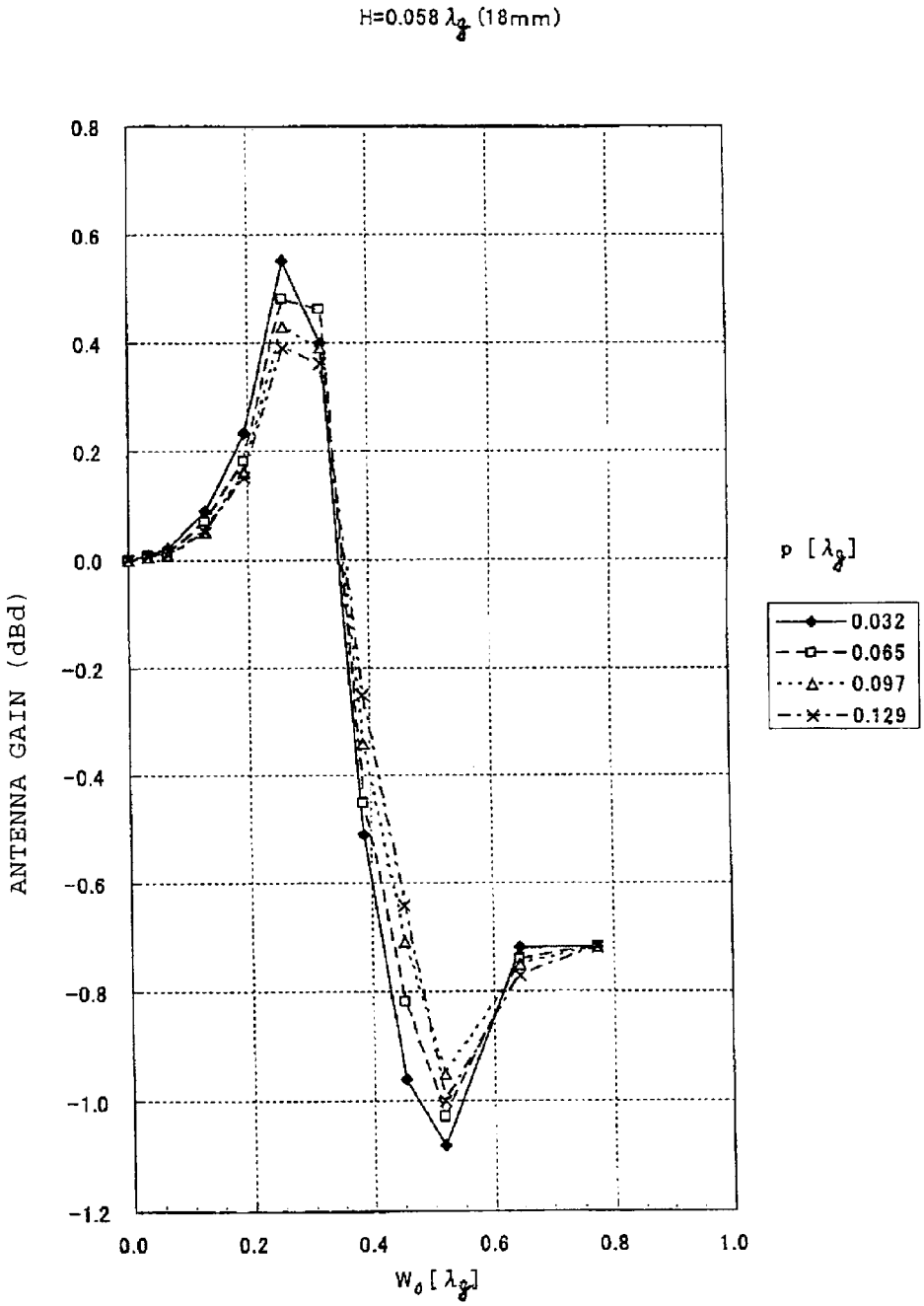
FIG. 18 is a characteristic graph of $W_0$-antenna gain at $H=0.058\ \lambda_g$ in Example 1.
Figure 19:
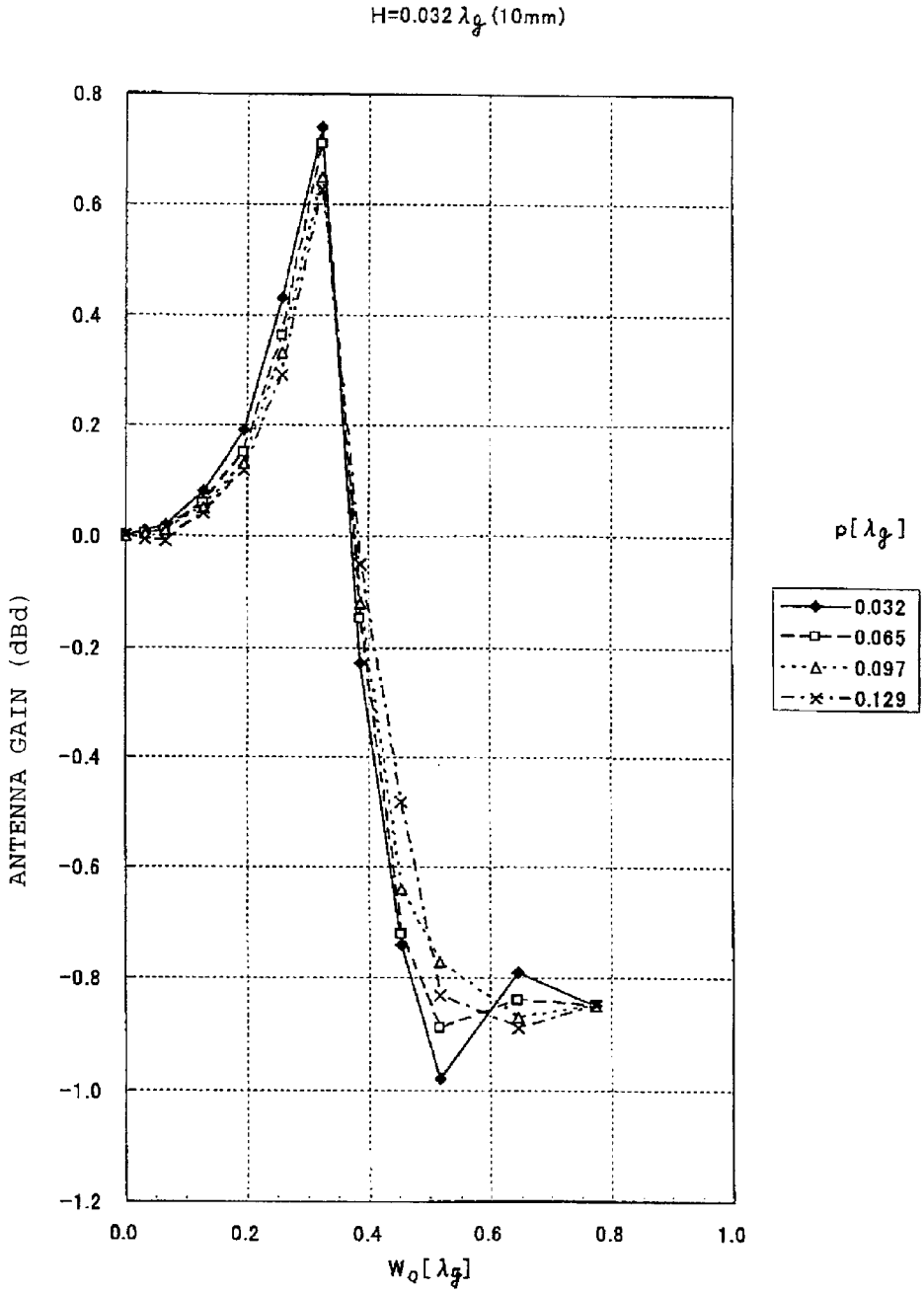
FIG. 19 is a characteristic graph of $W_0$-antenna gain at $H=0.032\ \lambda_g$ in Example 1.

FIG. 16 is a plan view showing the dimensional relationship in the embodiment shown in FIG. 1. In FIG. 16, no island-like conductors are shown. Respective numerical values are listed below. FIG. 17 is a characteristic graph showing $W_0$-antenna gain (average value) at H=0.078 $\lambda_g$ (24 mm). FIG. 18 is a characteristic graph showing $W_0$-antenna gain (average value) at H=0.058 $\lambda_g$ (18 mm). FIG. 19 is a characteristic graph showing $W_0$-antenna gain (average value) at H=0.032 $\lambda_g$ (10 mm). It should be noted that p is also altered in each of FIG. 17 and FIG. 18.

| | |
|---|---|
| Conductor width of island-like conductor (line width forming loop) | 1.0 mm |
| Thickness of rear window glass sheet 10 | 3.5 mm |
| Dielectric constant of rear window glass sheet 10 | 7.0 |
| $W_1$ (horizontal width of first antenna conductor 6) | 70 mm |
| $W_{2a}$ | 35 mm |
| $W_{2b}$ | 20 mm |
| Conductor width of first antenna conductor 6 | 1.0 mm |
| $W_3$ | 50 mm |
| $W_4$ | 660 mm |
| $W_5$ | 154 mm |
| $W_6$ | 215 mm |
| $W_7$ (maximum vertical width of vehicle opening edge for window 19) | 710 mm |
| $W_8$ (maximum transverse width of vehicle opening edge for window 19) | 1224 mm |
| $D_1$ | 21 mm |
| $D_2$ | 9 mm |
| $D_3$ | 18 mm |
| $D_4$ | 40 mm |
| $D_5$ | 62 mm |
| $D_6$ | 60 mm |
| $D_{11}$ | 10 mm |
| $L_1$ | 35 mm |
| $L_2$ (shortest distance between first antenna conductor 6 and heating wire 2a at highest position) | 77 mm |
| $L_3$ | 9 mm |
| $L_4$ | 70 mm |
| Conductor length of heating wire 2a at highest position (not including bus bars 5a and 5b) | 1100 mm |
| Line width of heating wires 2 | 1.0 mm |
| Conductor width of bus bars 5a and 5b | 10 mm |
| Conductor thickness of first antenna conductor 6 and heating wires 2 | 0.012 mm |
| Feed points 6a, 7a, 17a, 18a (height × width) | 12 × 20 mm |
| Conductor length of antenna conductor for FM broadcast | 495 mm |

Example 2

In each sample, it is assumed that the high frequency wave glass antenna for an automobile (FIG. 20 (seen from the car-interior-side) is configured so that the rear window glass sheet 10 does not include the antenna conductors 6 and 7, the feed points 6*a* and 7*a*, the antenna conductor for an FM broadcast 17, the antenna conductor for an AM broadcast, and the feed points 17*a* and 18*a* in FIG. 1, that the rear window glass sheet 10 includes the antenna conductor 26 at the center of the upper blank region thereof in the left-to-right direction thereof except for the defogger region, that the island-like conductor 1*a*, which comprises only a linear conductor, is disposed in a single location between the antenna conductor 26 and the heating wire 2*a* at the highest position or in the vicinity of such a single location, and that no other island-like conductors 1*a* and 1*b* are disposed. In FIG. 20, the specifications of the vehicle opening edge for a window 19, the defogger and the like except for the above-mentioned changed items are the same as those in Example 1.

Calculations are made for antenna gains, which are obtained when the island-like conductor 1*a* is moved parallel to a lower element of the antenna conductor 26 and from side to side. Respective numerical values, which are obtained by the calculations, are listed below. FIG. 21 is a characteristic graph showing $L_X$-antenna gain (average value).

It should be noted that $L_X$ is the distance between the center of the antenna conductor 26 in the left-to-right direction and the island-like-conductor-side imaginary straight line 16. The lower element of the antenna conductor 26 is axisymmetrical about the center of the rear window glass sheet in the left-to-right direction as the boundary. FIG. 21 is depicted so that $L_X$ takes a positive value when the island-like-conductor-side imaginary straight line 16 is disposed on the right side with respect to the center of the rear window glass sheet in the left-to-right direction.

| | |
|---|---|
| $W_0$ | 80 mm (0.259$\lambda_g$) |
| H | 0.029$\lambda_g$ (9 mm) to 0.116$\lambda_g$ (36 mm) |
| Conductor width of island-like conductor (line width forming loop) | 1.0 mm |
| $W_{11}$ (horizontal width of antenna conductor 26) | 150 mm (0.485$\lambda_g$) |
| $W_{12a}$ | 35 mm |
| $W_{12b}$ | 20 mm |
| Conductor width of antenna conductor 26 | 1.0 mm |
| $L_{11}$ | 9 mm (0.029$\lambda_g$) |
| $L_{12}$ (shortest distance between antenna conductor 26 and heating wire 2a at highest position) | 86 mm |
| $D_{11}$ (shortest distance between upper end portion of vehicle opening edge for window 19 and feed point 26a of antenna conductor 26) | 9 mm |
| Feed points 26a (vertical length × transverse length) | 12 × 20 mm |

Figure 22:
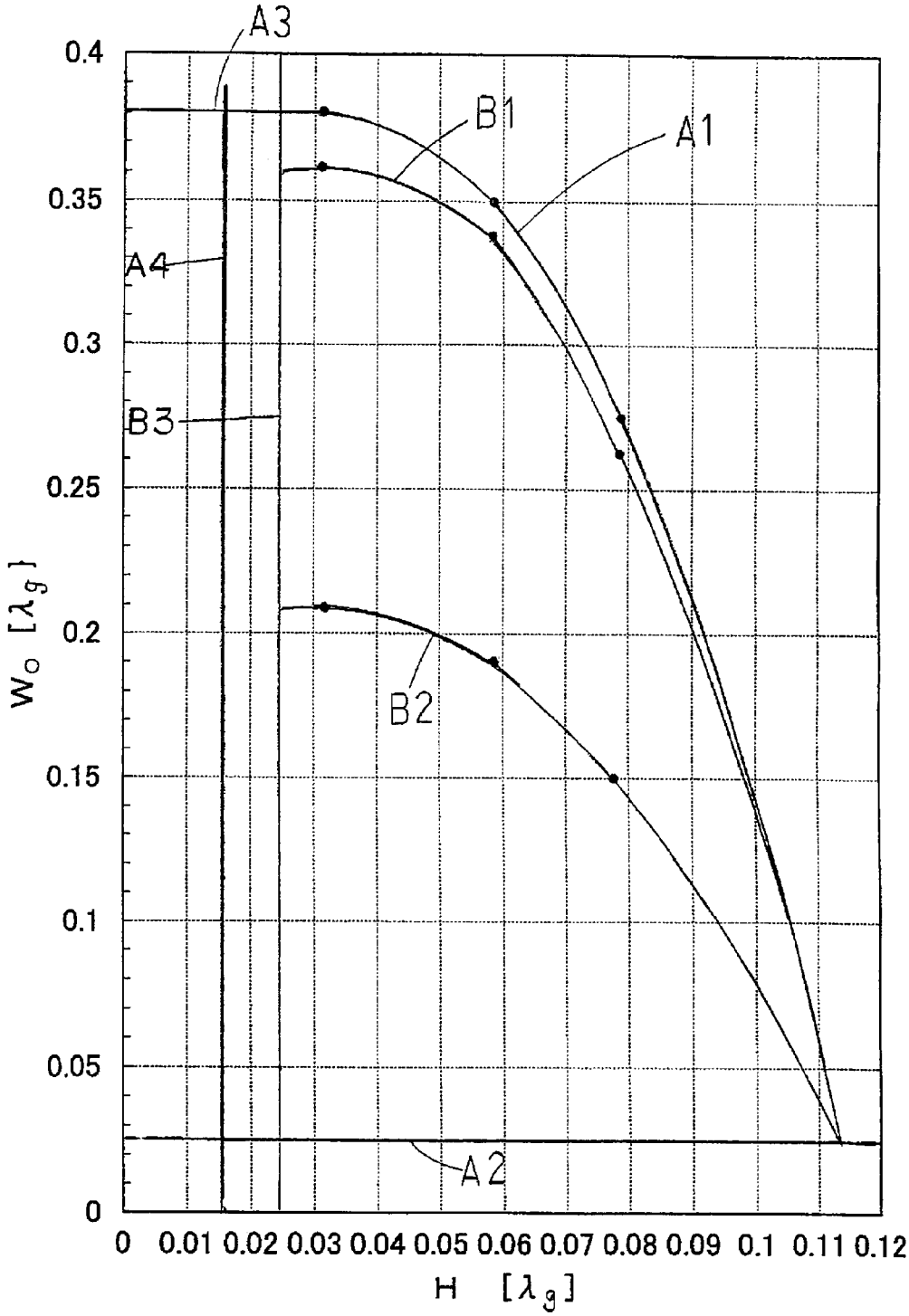
FIG. 22 is a graph showing the relationship between $W_0$ and H.

Depiction of FIG. 22

The relationship between $W_0$ and H is shown in the plane of coordinates of FIG. 22, which represents $W_0$ as the vertical axis and H as the horizontal axis. In FIG. 22, the respective straight lines are determined as described below. Lines A1 to A4 and B to B3 are determined based on the characteristics shown in FIGS. 17 to 19 and in consideration of the allowable range of each characteristic.

Example 3

Figure 24:
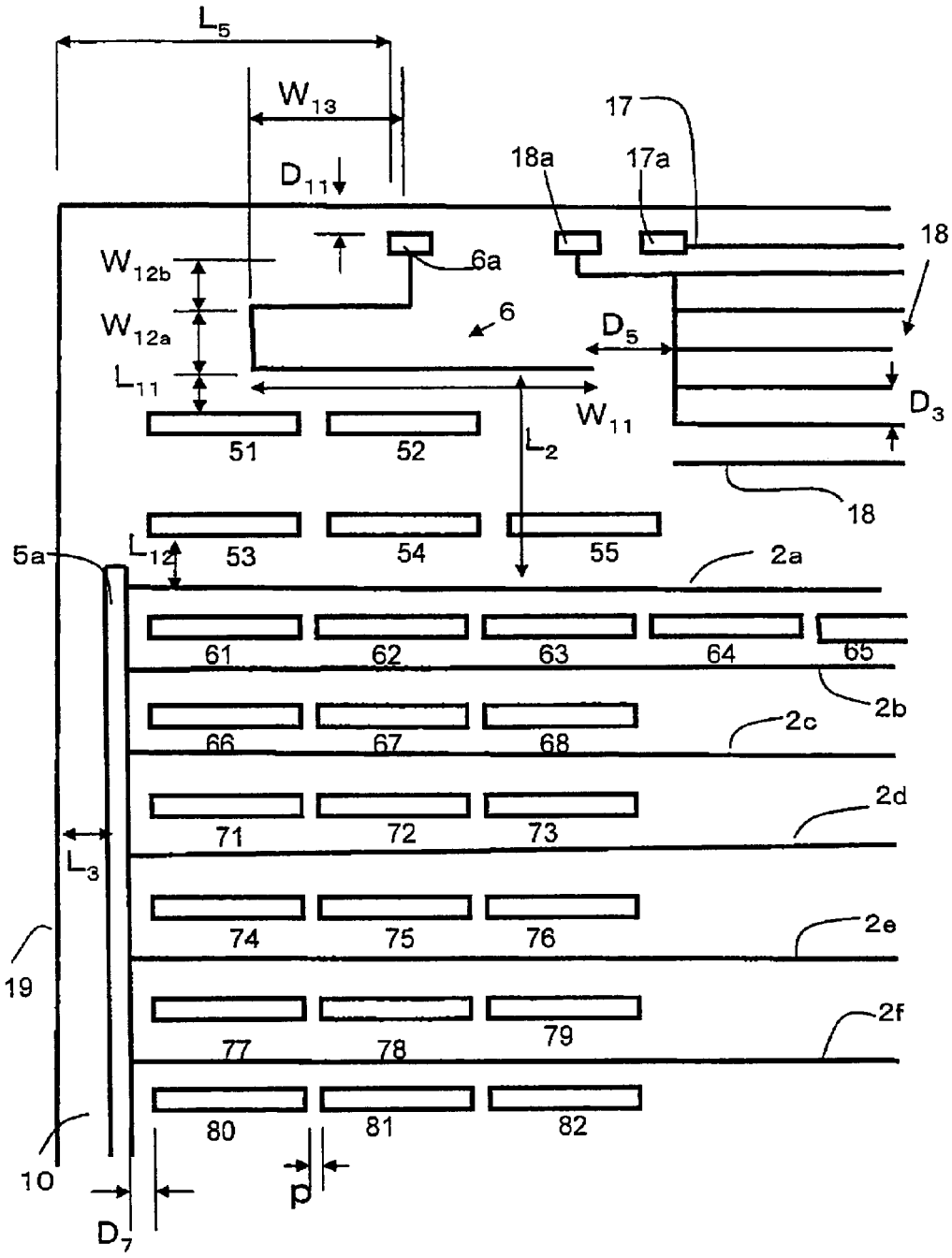
FIG. 24 is a plan view showing the high frequency wave glass antenna for an automobile in Example 4.

In each sample, the high frequency wave glass antenna for an automobile, which is shown in FIG. 24 (seen from the car-interior-side) was prepared, using a rear window glass sheet 10, which was fitted into an opening for an automobile window.

The antenna gains are represented by antenna gain average values (every 1°) within −90° to +90° in the horizontal direction (automobile backside) when the center of a rear portion of the automobile is set at 0 (zero)°, the left direction of the automobile is set at +90° and the center of a front portion of the automobile is set at +180°. The measurements were made at frequencies of 471 to 771 MHz (every 10 MHz) to find a characteristic of frequency-antenna gain with respect to horizontally polarized waves.

The rear window glass sheet 10 was inclined at an angle of 210 with respect to the horizontal direction. The antenna conductor for an AM broadcast 18 was short-circuited by a grounding conductor at the center of the rear window glass sheet 10 in the left-to-right direction, the grounding conductor extending vertically. The dimensions of the respective parts are listed below.

As shown in FIG. 24, the island-like conductor, which was formed in a rectangular loop shape, was disposed at each of positions 51 to 55, positions 61 to 68 and positions 71 to 82. It should be noted that only a left half portion of the island-like conductor is shown with respect to the position 65. These island-like conductors were prepared by sticking copper foil on the rear window glass sheet 10. The measurements were made by removing the island-like conductor disposed at an arbitrary position among all the positions. The antenna gains reduced by removal of the respective island-like conductors are listed in Table 2. In Table 2, for example, when the value of 0.21 dB is shown, it is meant that the antenna gain was reduced by 0.21 dB.

| | |
|---|---|
| Island-like conductor | 10 × 80 mm |
| Conductor width of island-like conductor (line width forming loop) | 0.8 mm |
| $D_3$ | 15 mm |
| $D_5$ | 20 mm |
| $D_7$ (distance between island-like conductor and bus bar 5a) (this distance is also equally applied to respective island-like conductors at positions 61, 66, 71, 74, 77 and 80.) | 5 mm |
| p (this distance is also equally applied to 5 positions 51 to 55, positions 61 to 68 and positions 71 to 82.) | 20 mm |
| $D_{11}$ | 10 mm |
| Shortest distance between island-like conductor at position 51 and left end of vehicle opening edge for window 19 | 25 mm |

-continued

| | |
|---|---|
| Shortest distance between island-like conductor at position 53 and left end of vehicle opening edge for window 19 | 25 mm |
| $L_2$ | 56 mm |
| $L_3$ | 10 mm |
| $L_5$ | 170 mm |
| $L_{11}$ | 9 mm |
| $L_{12}$ | 9 mm |
| $W_{11}$ | 140 mm |
| $W_{12a}$ | 35 mm |
| $W_{12b}$ | 20 mm |
| $W_{13}$ | 70 mm |
| Feed points 6a | 12 × 20 mm |
| Conductor width of bus bar 5a | 10 mm |
| Distance between adjacent heating wires | 30 mm |
| Conductor length of antenna conductor for FM broadcast 17 | 630 mm |
| Conductor length of antenna conductor for AM broadcast 18 (transverse width of each of five antenna conductors) | 700 mm |
| Distance between antenna conductor for AM broadcast 18 and heating wire 2a at highest position | 40 mm |
| Maximum vertical width × maximum transverse width of vehicle opening edge for window 19 | 710 × 1224 mm |
| Number of heating numbers | 17 |

TABLE 2

| Position number, from which island-like conductor is removed | Antenna gain (dB) | Position number, from which island-like conductor is removed | Antenna gain (dB) | Position number, from which island-like conductor is removed | Antenna gain (dB) |
|---|---|---|---|---|---|
| 51 | 0.36 | 52 | 0.02 | | |
| 53 | 0.21 | 54 | 0.13 | 55 | 0.06 |
| 61 | 0.07 | 62 | 0.21 | 63 | 0.05 |
| 64 | 0.02 | 65 | 0.01 | | |
| 66 | 0.07 | 67 | 0.14 | 68 | 0.00 |
| 71 | 0.07 | 72 | 0.05 | 73 | 0.00 |
| 74 | 0.00 | 75 | 0.05 | 76 | 0.00 |
| 77 | 0.02 | 78 | 0.00 | 79 | 0.01 |
| 80 | 0.01 | 81 | 0.01 | 82 | 0.01 |

Example 4

In each sample, it is assumed that a high frequency wave glass antenna for an automobile as shown in FIG. 24 is prepared. It is assumed that the rear window glass sheet 10 is similar to the one assumed in Example 1, and that the antenna conductor for an FM broadcast 17, the feed point 17*a*, the antenna conductor an AM broadcast 18, the feed point 18*a* are not disposed.

It is assumed that the island-like conductor is not disposed at each of the positions 51, 53 and 55, the positions 61 to 68, and the positions 71 to 82, and that a single straight line island-like conductor is disposed in the vicinity of the position 52 and 54. In other words, it is assumed that a single straight line island-like conductor is disposed between the antenna conductor 6 and the heating wire 2*a* at the highest position.

Average antenna gains were calculated on the conditions that the distance between the antenna-side imaginary straight line 12 (not shown in FIG. 24 but shown in FIG. 20) and the island-like-conductor-side imaginary straight line 16 (not shown in FIG. 24 but shown in FIG. 20) was set at 0 mm, that the conductor length (the maximum width in the longitudinal direction) of this island-like conductor was changed from 20 to 160 mm (every 20 mm) (from 0.065 $\lambda_g$ to 0.517 $\lambda_g$), and that the distance between the antenna conductor 6 and the island-like conductor was changed from 8 to 56 mm (from 0.026 $\lambda_g$ to 0.181 $\lambda_g$) for the respective changes in the conductor length of the island-like conductor.

Figure 25:
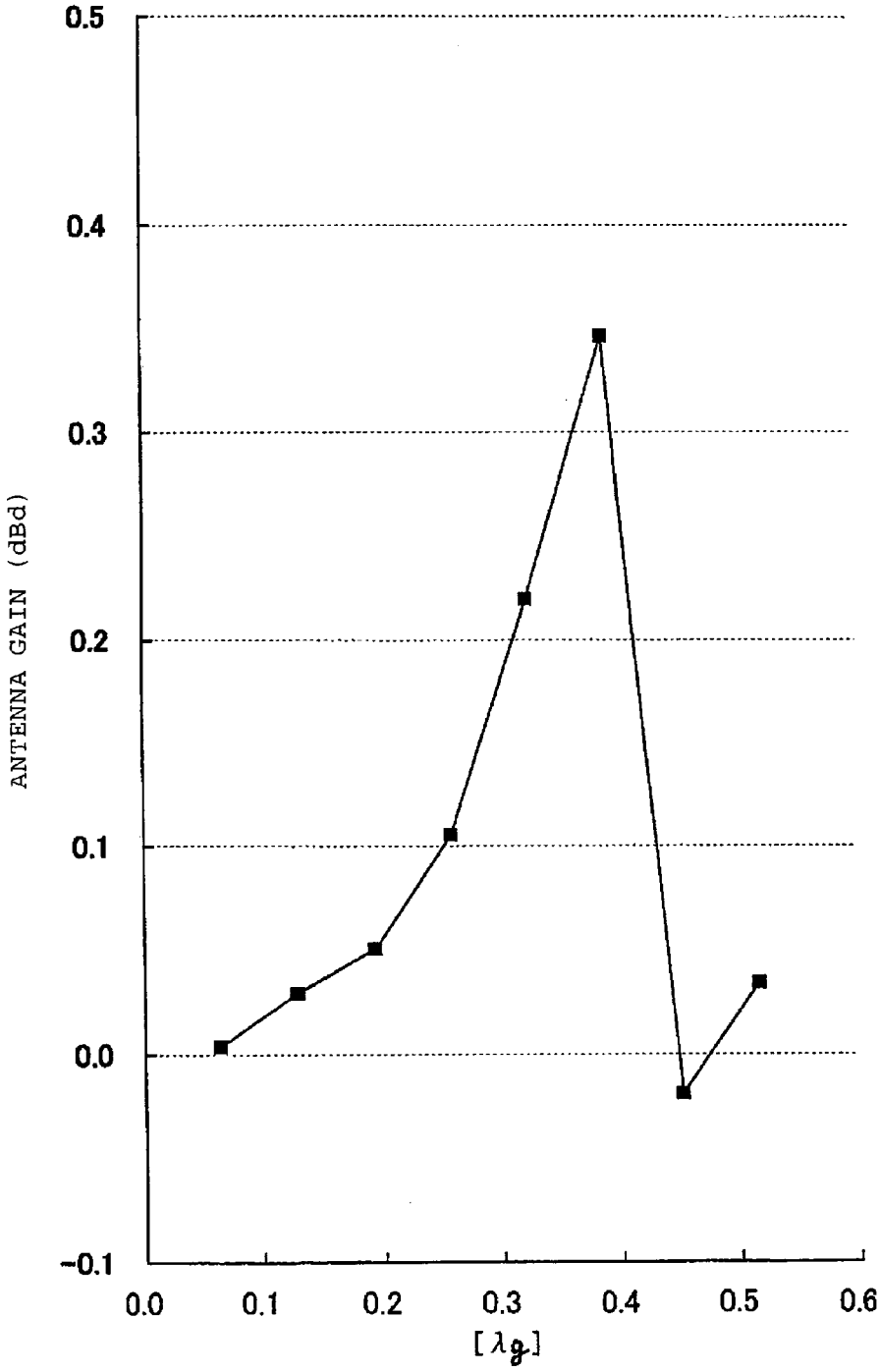
FIG. 25 is a characteristic graph, which represents antenna gains as the vertical axis and conductor lengths of an island-like conductor as the horizontal axis in Example 4.

FIG. 25 is a characteristic graph, which represents maximum antenna gains (average antenna gains for respective frequencies) as the vertical axis and conductor lengths of the island-like conductor as the horizontal axis, the antenna gains, which had maximum values when the distance between the antenna conductor 6 and the island-like conductor was changed from 8 to 56 mm for the respective changes in the conductor length of the island-like conductor, being extracted as the maximum antenna gains. In other words, for example, when the conductor length of the island-like conductor is 20 mm, the antenna gain that has the maximum value when the distance between the antenna conductor 6 and the island-like conductor is changed from 8 to 56 mm is adopted. The antenna gains are represented by average values for the respective frequencies as stated above.

The dimensions of the respective parts are listed below. The dimensions that are not listed below, and the dimensions and position of the feed point 6*a* are the same as ones in Example 1.

| | |
|---|---|
| Conductor width of island-like conductor (line width of straight line) | 1.0 mm |
| $D_{11}$ | 10 mm |
| $L_2$ | 77 mm |
| $L_3$ | 10 mm |
| $W_{11}$ | 150 mm |
| $W_{12a}$ | 35 mm |
| $W_{12b}$ | 15 mm |
| $W_{13}$ | 75 mm |

Example 5

Figure 26:
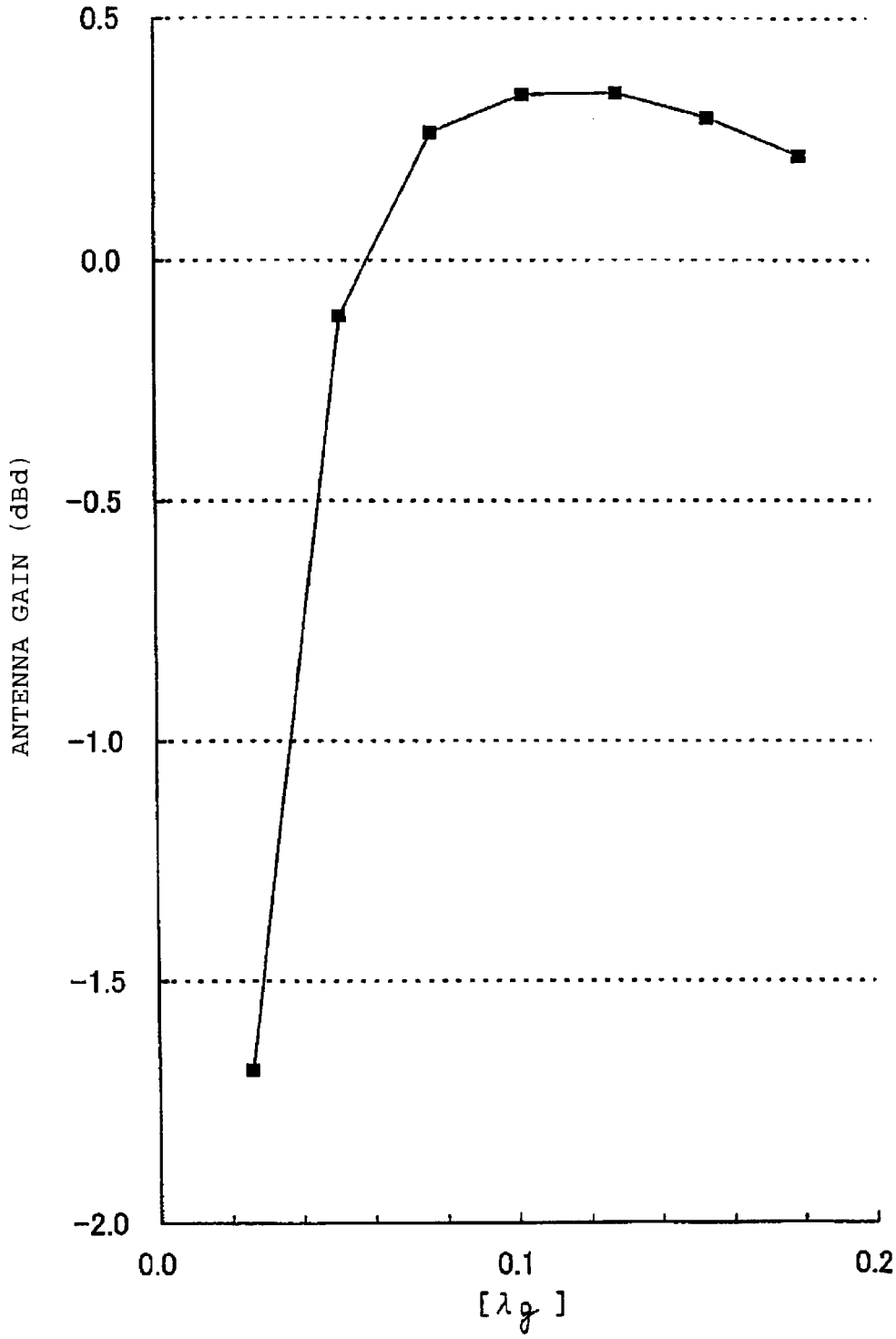
FIG. 26 is a graph of characteristic, which represents average antenna gains as the vertical axis and distances between an antenna conductor and an island-like conductor as the horizontal axis in Example 5.

Calculations similar to Example 4 were made for samples, which had the respective parts formed in the same dimensions as the ones of Example 4 except that the conductor length of the island-like conductor was fixed at 0.388 $\lambda_g$ (120 mm). The average antenna gains were calculated, changing the distance between the antenna conductor 6 and the island-like conductor from 8 to 56 mm as in Example 4. FIG. 26 is a characteristic graph, which represents the average antenna gains as the vertical axis and the distances between the antenna conductor 6 and the island-like conductor as the horizontal axis.

Example 6

In each sample, it is assumed that a high frequency wave glass antenna for an automobile as shown in FIG. 24 is prepared. It is assumed that the rear window glass sheet 10 is prepared in the same way as the one assumed in Example 1 and that the antenna conductor for an FM broadcast 17, the feed point 17*a*, the antenna conductor for an AM broadcast 18 and the feed point 18*a* are not disposed.

It is assumed that a total of six straight line island-like conductors are disposed in the respective positions 61, 62, 66, 67, 71 and 72 without the island-like conductor being disposed at each of the positions 51 to 55, the positions 63 to 65 and 68, and the positions 73 to 82. It is assumed that each of the island-like conductors is disposed at an intermediate position between the two adjacent heating wires thereabove and thereunder. The antenna gains are represented by calculating average values for the respective frequencies as stated above. The dimensions of the respective parts are listed below. The shape and the dimensions of the antenna conductor are the same as the ones in Example 4. The dimensions that were not listed below, and the dimensions and the positions of the feed point 6*a* are the same as those in Example 1. When these six island-like conductors are disposed, the average antenna gains are improved by 0.8 dB in comparison with a case without the island-like conductors.

| | |
|---|---|
| Conductor length of island-like conductor (maximum width in longitudinal direction) | 100 mm |
| Conductor width of island-like conductor (line width of straight line) | 1.0 mm |
| p | 20 mm |
| $D_7$ (distance between each of island-like conductors at positions 61, 66 and 71 and bus bar 5a) | 20 mm |

INDUSTRIAL APPLICABILITY

The present invention is applicable to a glass antenna for an automobile, which receives a digital terrestrial television broadcast, an analog television broadcast in Japan and a US digital television broadcast in the UHF band, an EU digital television broadcast or a Chinese digital television broadcast. The present invention is also applicable to the Japanese FM broadcast band (76 to 90 MHz), the US FM broadcast band (88 to 108 MHz), the television VHF band (90 to 108 MHz and 170 to 222 MHz), the 800 MHz band for automobile telephones (810 to 960 MHz), the 1.5 GHz band for automobile telephones (1.429 to 1.501 GHz), the UHF band (300 MHz to 3 GHz), the GPS (Global Positioning System), the GPS signal for artificial satellites (1,575.42 MHz) and the VICS (Vehicle Information and Communication System: 2.5 GHz).

Further, the present invention is applicable to the ETC communication (Electronic Toll Collection System: non-stop automatic fare collection system, transmit frequency of roadside wireless equipment: 5.795 GHz or 5.805 GHz, reception frequency of roadside wireless equipment: 5.835 GHz or 5.845 GHz), the DSRC (Dedicated Short Range Communication in the 915 MHz band, the 5.8 GHz band and the 60 GHz band), communication using a microwave (1 GHz to 3 THz), communication using millimeter wave (30 to 300 GHz), communication for the automobile keyless entry system (300 to 450 MHz), and communication for the SDARS (Satellite Digital Audio Radio Service (2.34 GHz and 2.6 GHz)).

The entire disclosure of Japanese Patent Application No. 2006-142845 filed on May 23, 2006 including specification, claims, drawings and summary is incorporated herein by reference in its entirety.

What is claimed is:

1. A high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper blank region of the rear window glass sheet except for a defogger region;

wherein it is assumed that there is a line, which passes through the center of the antenna conductor or the center of gravity thereof, and which extends parallel to the heating wire at the highest position, is called an imaginary parallel line; and an island-like conductor containing a linear conductor is disposed at one or more locations in a region of the rear window glass sheet between the imaginary parallel line and the heating wire at the highest position as viewed three-dimensionally.

2. The glass antenna according to claim 1, wherein the island-like conductor consists of only the linear conductor.

3. The glass antenna according to claim 1, wherein the linear conductor is formed in a loop shape.

4. The glass antenna according to claim 3, wherein the loop shape is polygonal, substantially polygonal, circular, substantially circular, oval or substantially oval.

5. The glass antenna according to claim 3, wherein the loop shape is quadrangular, substantially quadrangular, triangular or substantially triangular.

6. The glass antenna according to claim 3, wherein the loop shape is oblong or substantially oblong.

7. The glass antenna according to claim 3, wherein when the loop is formed in a quadrangular or substantially quadrangular shape, the loop is formed in such a shape as to have one side of the four sides or two sides of the four sides cut out therein, forming a cut-out portion or cut-out portions; and wherein when two sides of the four sides cut out, adjacent two sides are cut out.

8. The glass antenna according to claim 3, wherein the loop is formed in a quadrangular or substantially quadrangular shape, and wherein at least one of an upper side and a lower side of the loop extends parallel or substantially parallel to the heating wire closest to the island-like conductor.

9. The glass antenna according to claim 3, wherein the loop is formed in an oval or substantially oval shape, and wherein the major axis of the oval or substantially oval shape extends parallel or substantially parallel to the heating wire closest to the island-like conductor.

10. The glass antenna according to claim 1, wherein the linear conductor is formed in such a semi-loop shape that a discontinuity is formed in a portion of a loop shape.

11. The glass antenna according to claim 1, wherein the linear conductor is formed in such a shape as to have a cut-out portion like something that has a portion of a loop shape cut out therein.

12. The glass antenna according to claim 1, wherein the island-like conductor has a main portion comprising a straight line or substantially straight line conductor.

13. The glass antenna according to claim 12, wherein when a received radio wave has a frequency having a wavelength of $\lambda_0$ in the air, when glass has a shortening coefficient of wavelength of k, when the formula of k=0.64 is established and when the formula or $\lambda_g=\lambda_0 \cdot k$ is established;

the island-like conductor has a maximum width ranging from 0.13 $\lambda_g$ to 0.44 $\lambda_g$ in a longitudinal direction thereof.

14. The glass antenna according to claim 1, wherein the island-like conductor comprises a straight line or substantially straight line conductor.

15. The antenna conductor according to claim 12, wherein the island-like conductor has a linear conductor attached thereto so as to extend perpendicular or substantially perpendicular thereto and to have a conductor length of not longer than ⅕ of a maximum width thereof in a longitudinal direction thereof.

16. The glass antenna according to claim 12, wherein when a received radio wave has a frequency having a wavelength of $\lambda_0$ in the air, when glass has a shortening coefficient of wavelength of k, when the formula of k=0.64 is established and when the formula or $\lambda_g=\lambda_0 \cdot k$ is established;

the island-like conductor is disposed at one or more locations in a region of the rear window glass sheet between the imaginary parallel line and the heating wire at the highest position as viewed three-dimensionally;

wherein when the island-like conductor is disposed at a single location, the antenna conductor and the island-like conductor have an average distance of 0.06 $\lambda_g$ to 200 mm therebetween; and wherein when the island-like conductor is disposed at each of plural locations, the antenna conductor and each of the island-like conductors have an average distance of 0.06 $\lambda_g$ to 200 mm therebetween.

17. The glass antenna according to claim 1, wherein when the island-like conductor is disposed at a single location, the island-like conductor is connected, directly or through a connecting conductor, to at least one of the heating wires and the bus bars; and wherein when the island-like conductor is disposed at each of plural locations, at least one of the island-like conductors is connected, directly or through a connecting conductor, to at least one of the heating wires and the bus bars.

18. The glass antenna according to claim 1, wherein when the island-like conductor has a maximum vertical width of H in a vertical direction thereof, when the island-like conductor has a maximum transverse width of $W_0$ in a transverse direction thereof, when a received radio wave has a frequency having a wavelength of $\lambda_0$ in the air, when glass has a shortening coefficient of wavelength of k, when the formula of k=0.64 is established and when the formula of $\lambda_g=\lambda_0 \cdot k$ is established;

H and $W_0$ exist in a region surrounded by the following curve A1 and the following straight line A2 in a region satisfying the formula of $H \geqq 0.032\ \lambda_g$ on a plane of coordinates representing H as the horizontal axis and $W_0$ as the vertical axis:

| | |
|---|---|
| $W_0 = -(56.8/\lambda_g)\,(H - 0.035\lambda_g)^2 + 0.38\lambda_g$ | curve A1 |
| $W_0 = 0.025\lambda_g$ | straight line A2; |

and

H and $W_0$ exist in a region surrounded by the straight line A2, the following straight line A3 and the following straight line A4 in a region satisfying the formula of $H<0.032\ \lambda_g$ on the plane of coordinates:

| | |
|---|---|
| $W_0 = 0.38\lambda_g$ | straight line A3 |
| $H = 0.016\lambda_g$ | straight line A4 |

19. The glass antenna according to claim 18, wherein $\lambda_g$ is 309.2 mm.

20. The glass antenna according to claim 18, wherein $\lambda_g$ is 358.5 mm.

21. The glass antenna according to claim 18, wherein $\lambda_0$ is set at the wavelength of the center frequency of a desired broadcast frequency band in the air.

22. The glass antenna according to claim 18, wherein $\lambda_0$ is set at the wavelength of a frequency of 535.5 MHz in the air.

23. The glass antenna according to claim 1, wherein in a case where a received radio wave has a frequency having a wavelength of $\lambda_0$ in the air, when glass has a shortening coefficient of wavelength of k, when the formula of k=0.64 is established and when the formula or $\lambda_g=\lambda_0 \cdot k$ is established;

when it is assumed that there is a straight line, which extends parallel to a plane parallel to a longitudinal direction of the automobile and the vertical direction, which passes through the center of the antenna conductor in a left-to-right direction of the antenna conductor, and which passes through the heating wire at the highest position, this straight line is called an antenna-side imaginary straight line;

when it is assumed that there is a straight line, which extends parallel to the plane parallel to the longitudinal direction of the automobile and the vertical direction, which passes through the center of the island-like conductor in a left-to-right direction of the island-like conductor, and which passes through the heating wire at the highest position, this straight line is called an island-like-conductor-side imaginary straight line;

the antenna conductor and the island-like conductor are disposed in or on the rear window glass sheet so that the antenna-side imaginary straight line and the island-like-conductor-side imaginary straight line have a shortest distance of 1.1 $\lambda_g$ or below therebetween as viewed three-dimensionally.

24. The glass antenna according to claim 23, wherein the antenna conductor and the island-like conductor are disposed in or on the rear window glass sheet so that the antenna-side imaginary straight line and the island-like-conductor-side imaginary straight line have a shortest distance of 0.1 $\lambda_g$ or above therebetween as viewed three-dimensionally.

25. The glass antenna according to claim 1, wherein in a case where a received radio wave has a frequency having a wavelength of $\lambda_0$ in the air, when glass has a shortening coefficient of wavelength of k, when the formula of k=0.64 is established and when the formula or $\lambda_g=\lambda_0 \cdot k$ is established, wherein when it is assumed that there is a straight line, which extends parallel to a plane parallel to a longitudinal direction of the automobile and the vertical direction, which has contact with a left edge of the antenna conductor, and which passes through at least one of the heating wires, this straight line is called a first imaginary straight line;

when it is assumed that there is a straight line, which extends parallel to the plane parallel to the longitudinal direction of the automobile and the vertical direction, which has contact with a right edge of the antenna conductor, and which passes through at least one of the heating wires, this straight line is called a second imaginary straight line;

the island-like conductor is partly or entirely disposed between the first imaginary straight line and the second imaginary straight line as viewed three-dimensionally, or otherwise a shorter one of a shortest distance between the island-like conductor and the first imaginary straight line, and a shortest distance between the island-like conductor and the second imaginary straight line, which is viewed three-dimensionally, is 0.728 $\lambda_g$ or below.

26. The glass antenna according to claim 1, wherein the antenna conductor is configured to have a function of receiving a digital television broadcast band in terms of shape and dimensions.

27. The glass antenna according to claim 1, wherein a received radio wave contains a frequency ranging from 471 to 771 MHz.

28. The glass antenna according to claim 1, wherein a received radio wave contains a frequency ranging from 471 to 600 MHz.

29. The glass antenna according to claim 1, wherein a received radio wave contains a frequency ranging from 471 to 710 MHz.

30. The glass antenna according to claim 1, wherein a received radio wave contains a frequency ranging from 698 to 806 MHz.

31. A rear window glass sheet for an automobile, including the antenna conductor, the defogger and the island-like conductor recited in claim 1.

32. A high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper blank region of the rear window glass sheet except for a defogger region;

wherein an island-like conductor containing a linear conductor is disposed at one or more locations in a blank space without having a bus bar or a heating wire, the blank space being in the defogger region.

33. The glass antenna according to claim 32, wherein in a case where it is assumed that there is a straight line, which extends parallel to a plane parallel to a longitudinal direction of the automobile and the vertical direction, which has contact with a left edge of the antenna conductor, and which passes through at least one of the heating wires, this straight line is called a first imaginary straight line; and where it is assumed that there is a straight line, which extends parallel to the plane parallel to the longitudinal direction of the automobile and the vertical direction, which has contact with a right edge of the antenna conductor, and which passes through at least one of the heating wires, this straight line is called a second imaginary straight line;

when the island-like conductor is disposed at a single location, the island-like conductor is partly or entirely disposed between the first imaginary straight line and the second imaginary straight line as viewed three-dimensionally, and when the island-like conductor is disposed at each of plural locations, at least one of the island-like conductors is partly or entirely disposed between the first imaginary straight line and the second imaginary straight line as viewed three-dimensionally.

34. A high frequency wave glass antenna for an automobile, comprising a plurality of heating wires and a plurality of bus bars for feeding the heating wires, disposed in or on an automobile rear window glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; a first antenna conductor disposed in a right portion of an upper blank region of the rear window glass sheet except for a defogger region; and a second antenna conductor disposed in a left portion of the upper blank region of the rear window glass sheet except for the defogger region;

wherein when it is assumed that there is a straight line, which extends parallel to a plane parallel to a longitudinal direction of the automobile and the vertical direction, which passes through the center of the first antenna conductor in a left-to-right direction thereof or the center of gravity thereof, and which passes through at least one of the heating wires, this straight line is called a first antenna-side imaginary straight line;

wherein when it is assumed that there is a straight line, which extends parallel to the plane parallel to the longitudinal direction of the automobile and the vertical direction, which passes through the center of the second antenna conductor in a left-to-right direction thereof or the center of gravity thereof, and which passes through at least one of the heating wires, this straight line is called a second antenna-side imaginary straight line;

wherein when a heating wire, which starts with a top portion of a first bus bar or a portion of the first bus bar in the vicinity of the top portion, which extends toward the center of the rear window glass sheet in a left-to-right direction thereof, and which reaches and is connected to a top portion of a second bus bar or a portion of the second bus bar in the vicinity of the top portion, is called a highest original heating wire;

the highest original heating wire has at least one branch heating wire branched off thereof on the way to the center of the rear window glass sheet in the left-to-right direction after the highest original heating wire intersects or crosses over or under the first antenna-side imaginary straight line, after the branch heating wire branches off of the highest original heating wire and extends further, the branch heating wire bends so as to extend parallel or substantially parallel to the highest original heating wire and extend toward the center of the rear glass window sheet in the left-to-right direction, and bends to join and be connected to the highest original heating wire on the way to a location where the highest original heating wire intersects or crosses over or under the second antenna-side imaginary straight line;

wherein the first antenna conductor and the highest original heating wire have one or plural island-like conductors disposed therebetween;

wherein the second antenna conductor and the highest original heating wire have one or plural island-like conductors disposed therebetween;

wherein the highest original heating wire and the heating wire just under the highest original heating wire have one or plural island-like conductors disposed therebetween under the first antenna conductor;

wherein the highest original heating wire and the heating wire just under the highest original heating wire have one or plural island-like conductors disposed therebetween under the second antenna conductor; and wherein each of the island-like conductors contains a linear conductor.

35. The glass antenna according to claim 34, wherein the one or plural island-like conductors, which are disposed between the first antenna conductor and the highest original heating wire, are formed in a rectangular or substantially rectangular loop shape;

wherein the one or plural island-like conductors, which are disposed between the second antenna conductor and the highest original heating wire, are formed in a rectangular or substantially rectangular loop shape;

wherein the one or plural island-like conductors, which are disposed between the highest original heating wire and the heating wire just under the highest original heating wire under the first antenna conductor, have a main portion comprising a straight line or substantially straight line conductor; and wherein the one or plural island-like conductors, which are disposed between the highest original heating wire and the heating wire just under the highest original heating wire under the second antenna conductor, have a main portion comprising a straight line or substantially straight line conductor.

36. The glass antenna according to claim 34, wherein each of the first antenna conductor and the second antenna conductor is configured to have a function of receiving a digital television broadcast band in terms of shape and dimensions.

* * * * *